US011433521B2

(12) United States Patent
Owens et al.

(10) Patent No.: US 11,433,521 B2
(45) Date of Patent: Sep. 6, 2022

(54) POWERED FASTENER DRIVER

(71) Applicant: MILWAUKEE ELECTRIC TOOL CORPORATION, Brookfield, WI (US)

(72) Inventors: Patrick J. Owens, LaGrange Park, IL (US); Andrew R. Wyler, Pewaukee, WI (US); Marcus Wechselberger, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 21 days.

(21) Appl. No.: 16/801,711

(22) Filed: Feb. 26, 2020

(65) Prior Publication Data

US 2020/0290189 A1 Sep. 17, 2020

Related U.S. Application Data

(60) Provisional application No. 62/834,998, filed on Apr. 17, 2019, provisional application No. 62/817,650, filed on Mar. 13, 2019.

(51) Int. Cl.
*B25C 1/00* (2006.01)

(52) U.S. Cl.
CPC ..... *B25C 1/005* (2013.01)

(58) Field of Classification Search
CPC ..... B25C 1/005; B25C 5/1658; B25C 5/1665
See application file for complete search history.

(56) References Cited

U.S. PATENT DOCUMENTS

| | | | | |
|---|---|---|---|---|
| 5,038,993 | A | 8/1991 | Schafer et al. | |
| 5,803,338 | A * | 9/1998 | Singer | B25C 1/005 227/110 |
| 6,053,389 | A | 4/2000 | Chu et al. | |
| 6,502,737 | B2 * | 1/2003 | Akiba | B25C 1/005 227/109 |
| 6,592,016 | B2 | 7/2003 | Hamano et al. | |
| 6,598,777 | B2 | 7/2003 | Osuga et al. | |
| 6,622,901 | B2 | 9/2003 | Hamano et al. | |

(Continued)

OTHER PUBLICATIONS

European Patent Office Extended Search Report for Application No. 20162176.0 dated Sep. 18, 2020 (8 pages).

(Continued)

*Primary Examiner* — Thomas M Wittenschlaeger
(74) *Attorney, Agent, or Firm* — Michael Best & Friedrich LLP

(57) ABSTRACT

A powered fastener driver includes a magazine in which fasteners of a first length or fasteners of a second length greater than the first length are receivable. The magazine includes a shear block located at a first end of the magazine, a loading portion located at a second end of the magazine, and a feed channel extending lengthwise through the magazine between. The loading portion of the magazine includes first and second slots configured to receive fasteners of the corresponding first and second lengths for entry into the feed channel, and a feed channel access gate configured to prevent fasteners of the first length from being loaded into the second slot. The feed channel access gate is configured as a pivot member pivotable about an axis between a first, blocking position, and a second, bypass position. A spring biases the feed channel access gate toward the blocking position.

12 Claims, 20 Drawing Sheets

(56) References Cited

U.S. PATENT DOCUMENTS

| | | | | |
|---|---|---|---|---|
| 6,641,022 | B2 | 11/2003 | Hamano et al. | |
| 6,679,414 | B2 | 1/2004 | Rotharmel | |
| 6,739,490 | B1 | 5/2004 | Shkolnikov et al. | |
| 6,808,101 | B2 | 10/2004 | Laubach et al. | |
| 6,908,021 | B1 * | 6/2005 | Wang | B25C 1/005 227/120 |
| 7,025,242 | B1 | 4/2006 | Schnell | |
| 7,143,508 | B2 | 12/2006 | Schnell et al. | |
| 7,243,831 | B2 | 7/2007 | Ishizawa et al. | |
| 7,398,905 | B2 * | 7/2008 | Chen | B25C 1/184 227/119 |
| 8,220,687 | B2 | 7/2012 | Yamamoto et al. | |
| 8,684,245 | B2 | 4/2014 | Canlas, Jr. et al. | |
| 8,931,676 | B2 | 1/2015 | Braddock | |
| 9,469,022 | B2 * | 10/2016 | Ishikawa | B25C 1/008 |
| 9,527,196 | B2 | 12/2016 | Segura | |
| 2008/0067212 | A1 * | 3/2008 | Wen | B25C 1/005 227/120 |
| 2010/0206934 | A1 | 8/2010 | Vallon et al. | |
| 2012/0298713 | A1 * | 11/2012 | Ronconi | B25C 1/005 227/120 |
| 2013/0320062 | A1 * | 12/2013 | Segura | B25C 1/005 227/109 |
| 2014/0361066 | A1 | 12/2014 | Liu et al. | |
| 2017/0100826 | A1 | 4/2017 | Segura | |
| 2018/0318993 | A1 | 11/2018 | Bodin et al. | |

OTHER PUBLICATIONS

Hitachi, "Instruction and Safety Manual NR65AK2, NR65AK2 (S)", available at least as early as Apr. 10, 2019, 60 pages.

* cited by examiner

POWERED FASTENER DRIVER

CROSS-REFERENCE TO RELATED APPLICATIONS

This application claims priority to U.S. Provisional Patent Application No. 62/834,998 filed Apr. 17, 2019 and U.S. Provisional Patent Application No. 62/817,650 filed Mar. 13, 2019, the entire contents of which are both incorporated herein by reference.

FIELD OF THE INVENTION

The present invention relates to powered fastener drivers, and more particularly to powered fastener drivers adapted to operate with fasteners of varying sizes.

BACKGROUND OF THE INVENTION

Users may use fasteners to attach hardware, e.g., piping clips (conduit, PVC sprinkler pipes), ceiling wire (conduit, HVAC ducts), and straps (HVAC ducts) to walls, ceilings, etc. Typically, such fasteners are driven into a workpiece by a powered fastener driver. The fasteners are collated into a strip and positioned within a magazine of the powered fastener driver. Some magazines can accommodate fasteners of different lengths.

SUMMARY OF THE INVENTION

The present invention provides, in one aspect, a powered fastener driver including a magazine in which fasteners of a first length or fasteners of a second length greater than the first length are receivable. The magazine includes a shear block located at a first end of the magazine, a loading portion located at a second end of the magazine opposite the first end, and a feed channel extending lengthwise through the magazine between the shear block and the loading portion. The loading portion of the magazine includes first and second slots that are configured to receive fasteners of the corresponding first and second lengths for entry into the feed channel. The loading portion of the magazine further includes a feed channel access gate configured to prevent fasteners of the first length from being loaded into the second slot. The feed channel access gate is configured as a pivot member pivotable about a pivot axis between a first, blocking position blocking access to the second slot, and a second, bypass position permitting access to the second slot. A spring biases the feed channel access gate toward the blocking position.

The present invention provides, in another aspect, a powered fastener driver including a magazine in which fasteners of a first length or fasteners of a second length greater than the first length are receivable. The magazine includes a shear block located at a first end of the magazine, a loading portion located at a second end of the magazine opposite the first end, and a feed channel extending lengthwise through the magazine between the shear block and the loading portion along a feed direction. The loading portion of the magazine includes first and second slots that are configured to receive fasteners of the corresponding first and second lengths for entry into the feed channel. The loading portion of the magazine further includes a feed channel access gate configured to prevent fasteners of the first length from being loaded into the second slot corresponding to the fasteners of the second length. The feed channel access gate is configured as a pivot member pivotable about a pivot axis parallel to the feed direction between a first, blocking position blocking access to the second slot, and a second, bypass position permitting access to the second slot.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

FIGS. 1-6 illustrate a power tool, such as a gas spring-powered fastener driver 10, operable to drive fasteners (e.g., nails, tacks, staples, etc.) held within a magazine 14 into a workpiece. The fastener driver 10 is configured as a multi-shot powered nailer including a magazine 14 holding a collated strip of nails, allowing the user to perform multiple fastening operations without having to manually reload the fastener driver after each driving cycle. In other embodiments, the fasteners can instead be embodied as staples, brads, etc. The fastener driver 10 can drive two different-length nails depending, for example, on the thickness of the workpiece to be fixed in place. The magazine 14 is capable of accommodating either short nails 16*a* (FIG. 14) or long nails 16*b* (FIG. 13), and advancing the nails 16*a*, 16*b* toward a firing position within the fastener driver 10. Although the magazine 14 will be described below in the context of the gas spring-powered fastener driver 10, the magazine 14 can equally be applied to other types of fastener drivers (e.g., a combustion nailer, a gas-free nailer, a pneumatic nailer, etc.).

Figure 2:
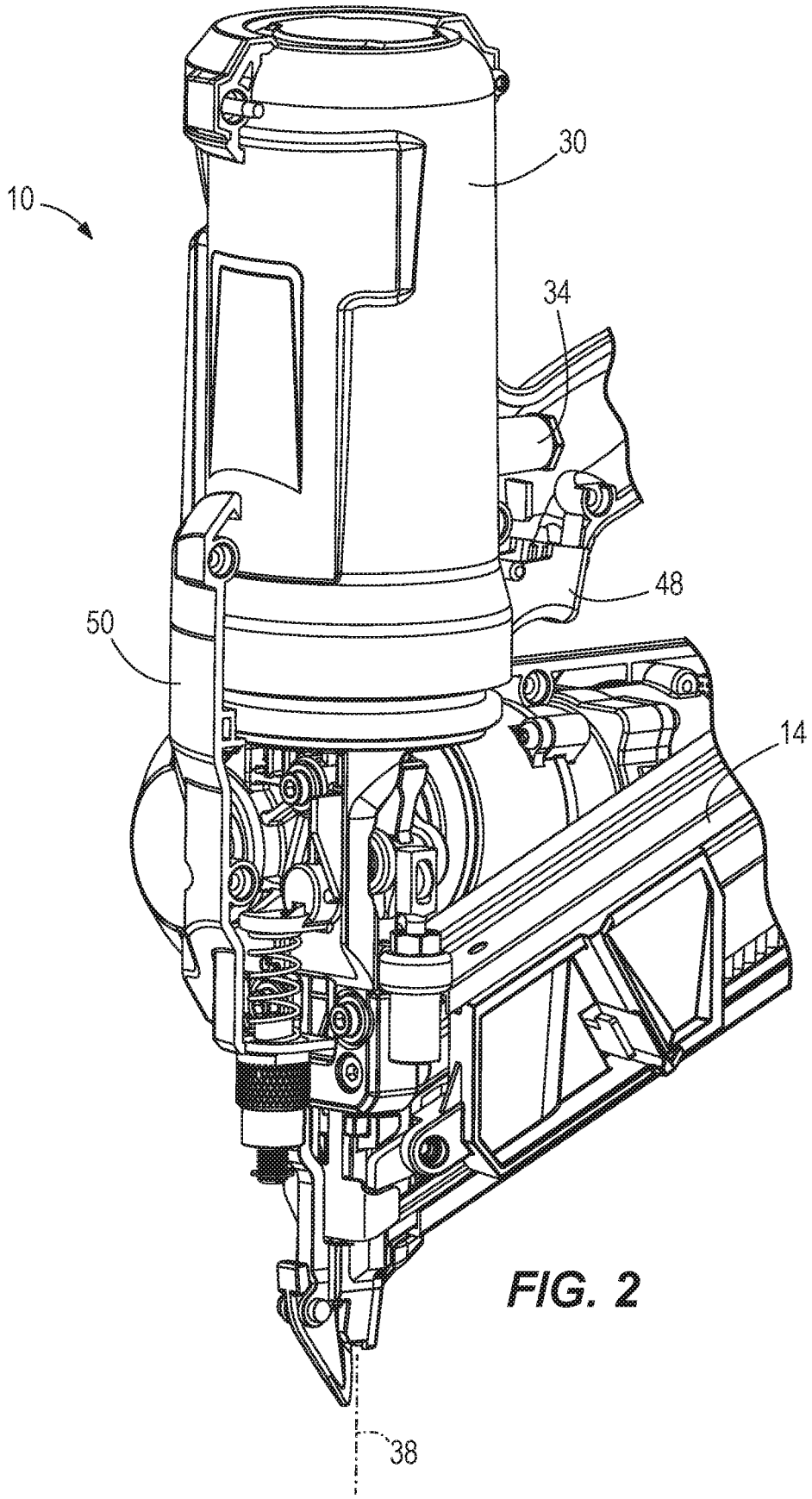
FIG. 2 is a partial cut-away view of the fastener driver of FIG. 1.
Figure 5:
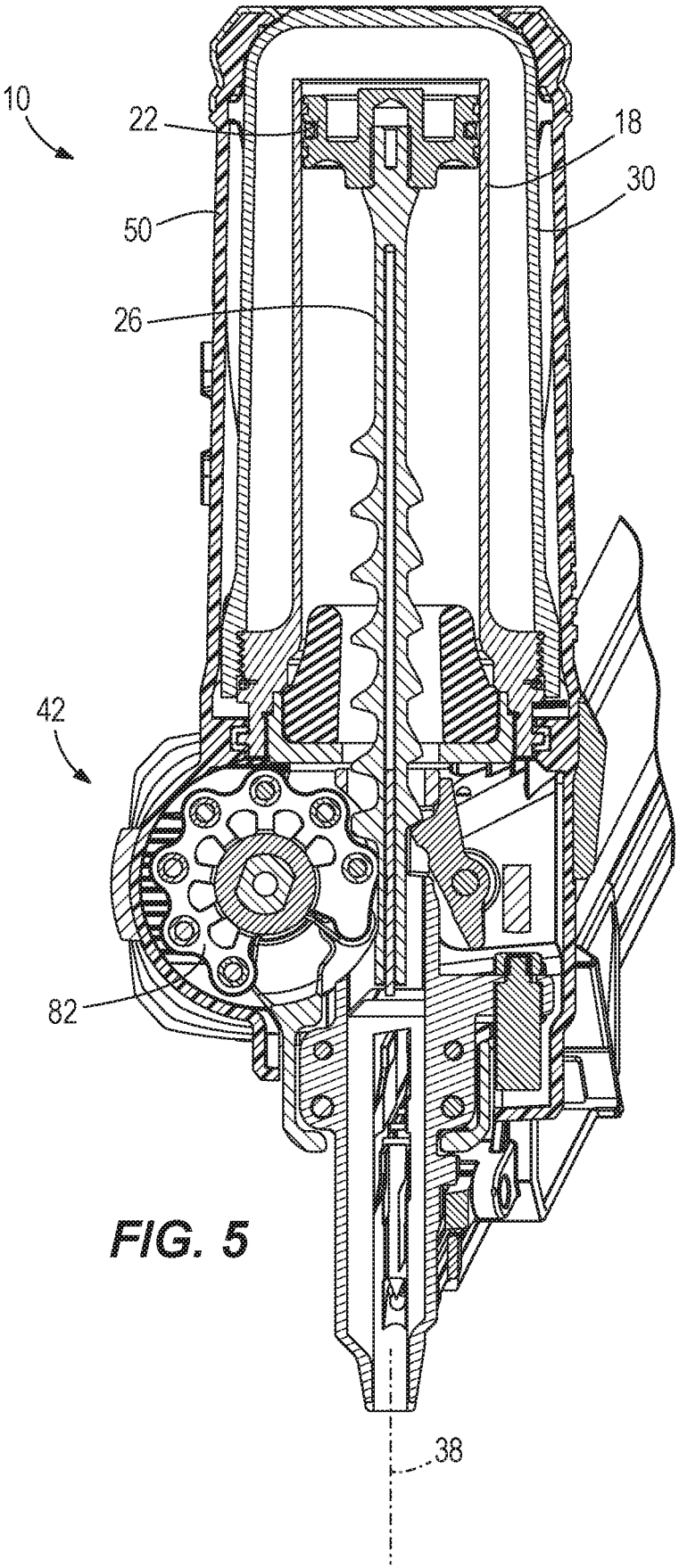
FIG. 5 is a cross-sectional view of the fastener driver of FIG. 1 taken along line 5-5 of FIG. 3, illustrating a driver blade in a ready position.
Figure 6:
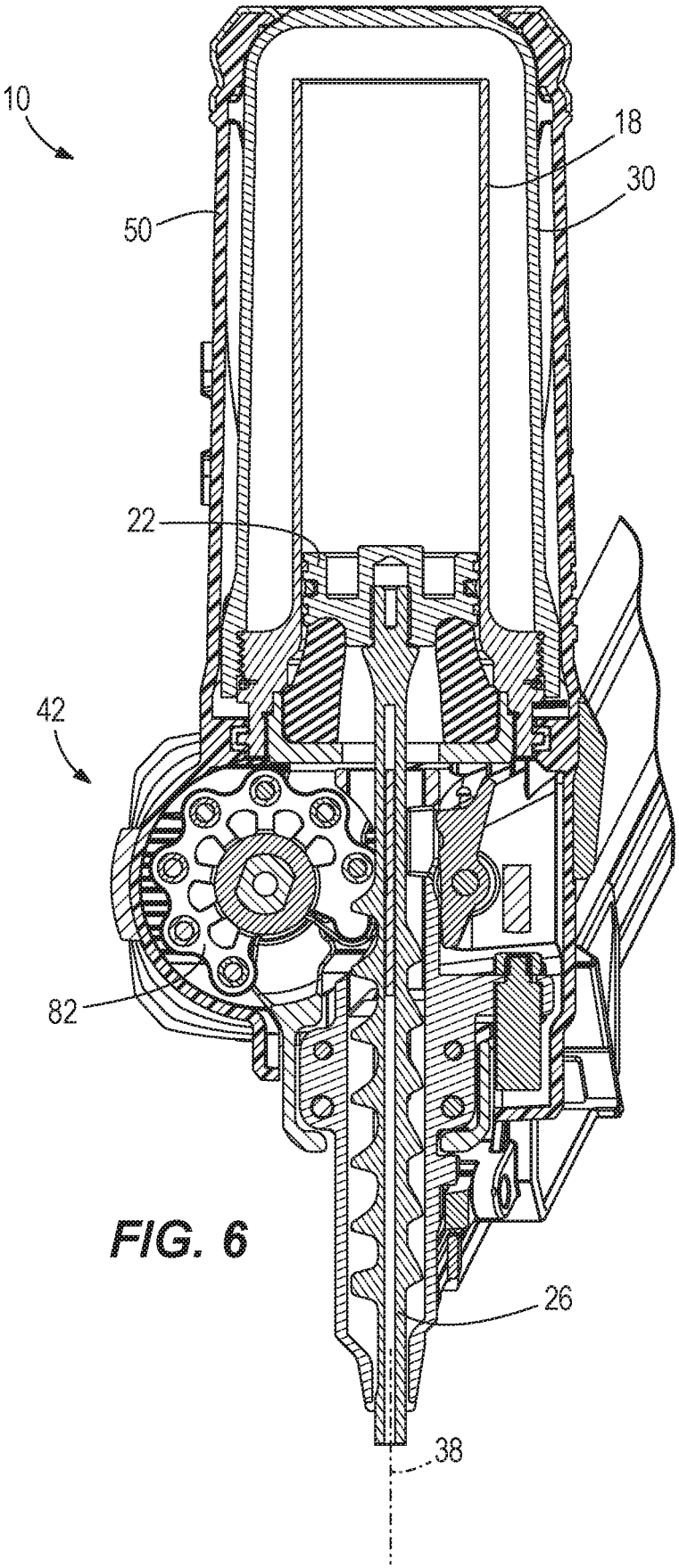
FIG. 6 is a cross-sectional view of the fastener driver of FIG. 1 taken along line 5-5 of FIG. 3, illustrating the driver blade in a driven position.

With reference to FIGS. 5 and 6, the gas spring-powered fastener driver 10 includes a cylinder 18 and a moveable piston 22 positioned within the cylinder 18. The fastener driver 10 further includes a driver blade 26 that is attached to the piston 22 and moveable therewith. The fastener driver 10 does not require an external source of air pressure, but rather includes a storage chamber cylinder 30 of pressurized gas in fluid communication with the cylinder 18. In the illustrated embodiment, the cylinder 18 and moveable piston 22 are positioned within the storage chamber cylinder 30. With reference to FIG. 2, the driver 10 further includes a fill valve 34 coupled to the storage chamber cylinder 30. When connected with a source of compressed gas, the fill valve 34 permits the storage chamber cylinder 30 to be refilled with compressed gas if any prior leakage has occurred. The fill valve 34 may be configured as a Schrader valve, for example.

The cylinder 18 and the driver blade 26 define a driving axis 38, and during a driving cycle the driver blade 26 and piston 22 are moveable between a ready position (i.e., top dead center; see FIG. 5) and a driven position (i.e., bottom dead center; see FIG. 6). The fastener driver 10 further includes a lifting assembly 42, which is powered by a motor 46 (FIG. 4), and which is operable to move the driver blade 26 from the driven position to the ready position.

Figure 1:
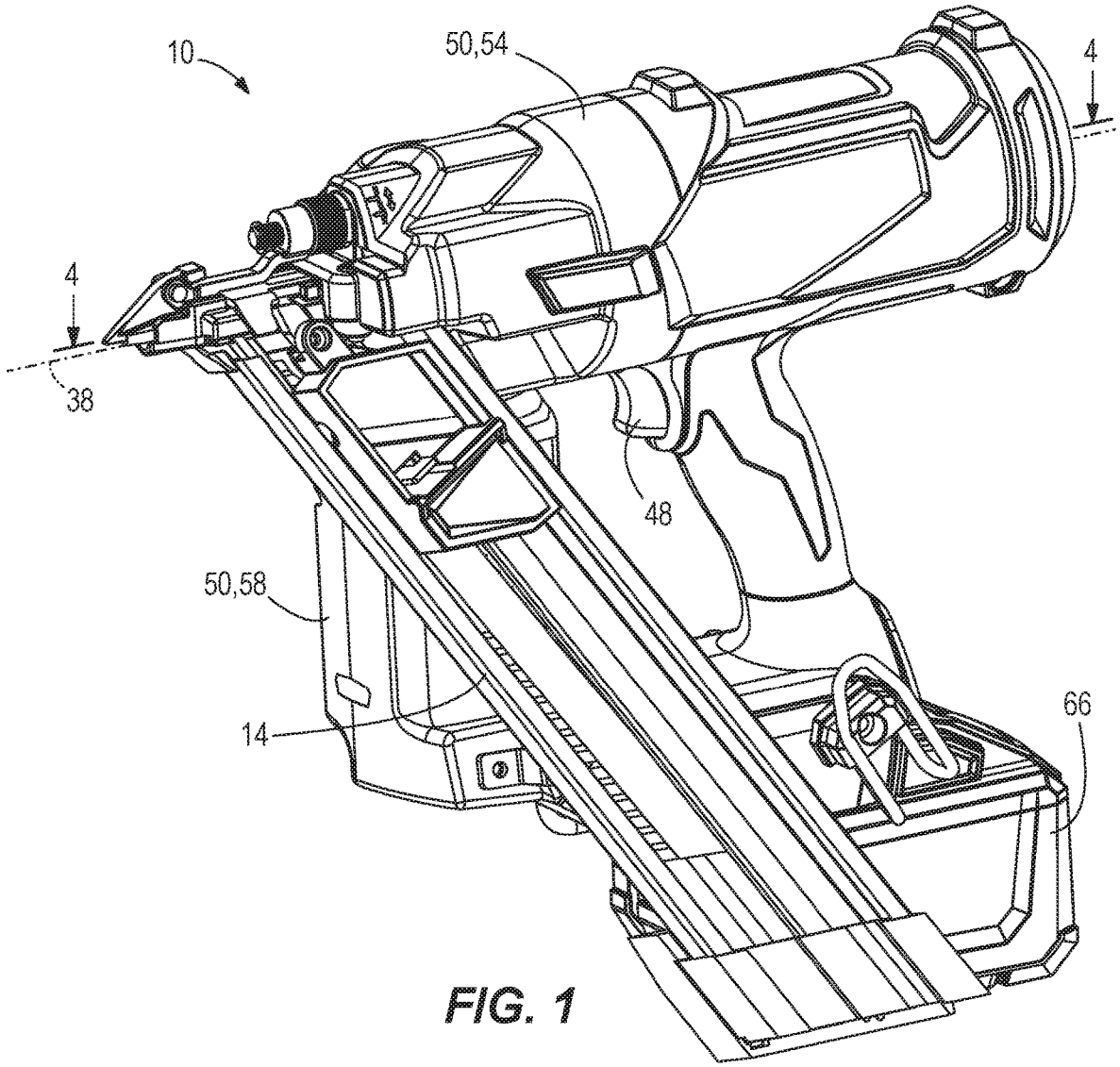
FIG. 1 is a perspective view of a gas spring-powered fastener driver in accordance with an embodiment of the invention.

In operation, the lifting assembly 42 drives the piston 22 and the driver blade 26 to the ready position by energizing the motor 46. As the piston 22 and the driver blade 26 are driven to the ready position, the gas above the piston 22 and the gas within the storage chamber cylinder 30 is compressed. Once in the ready position, the piston 22 and the driver blade 26 are held in position until released by user activation of a trigger 48 (FIG. 1). When released, the compressed gas above the piston 22 and within the storage chamber 30 drives the piston 22 and the driver blade 26 to the driven position, thereby driving the nail 16*a*, 16*b* into a workpiece. The illustrated fastener driver 10 therefore operates on a gas spring principle utilizing the lifting assembly 42 and the piston 22 to further compress the gas within the cylinder 18 and the storage chamber cylinder 30. Further detail regarding the structure and operation of the fastener driver 10 is provided below.

Figure 3:
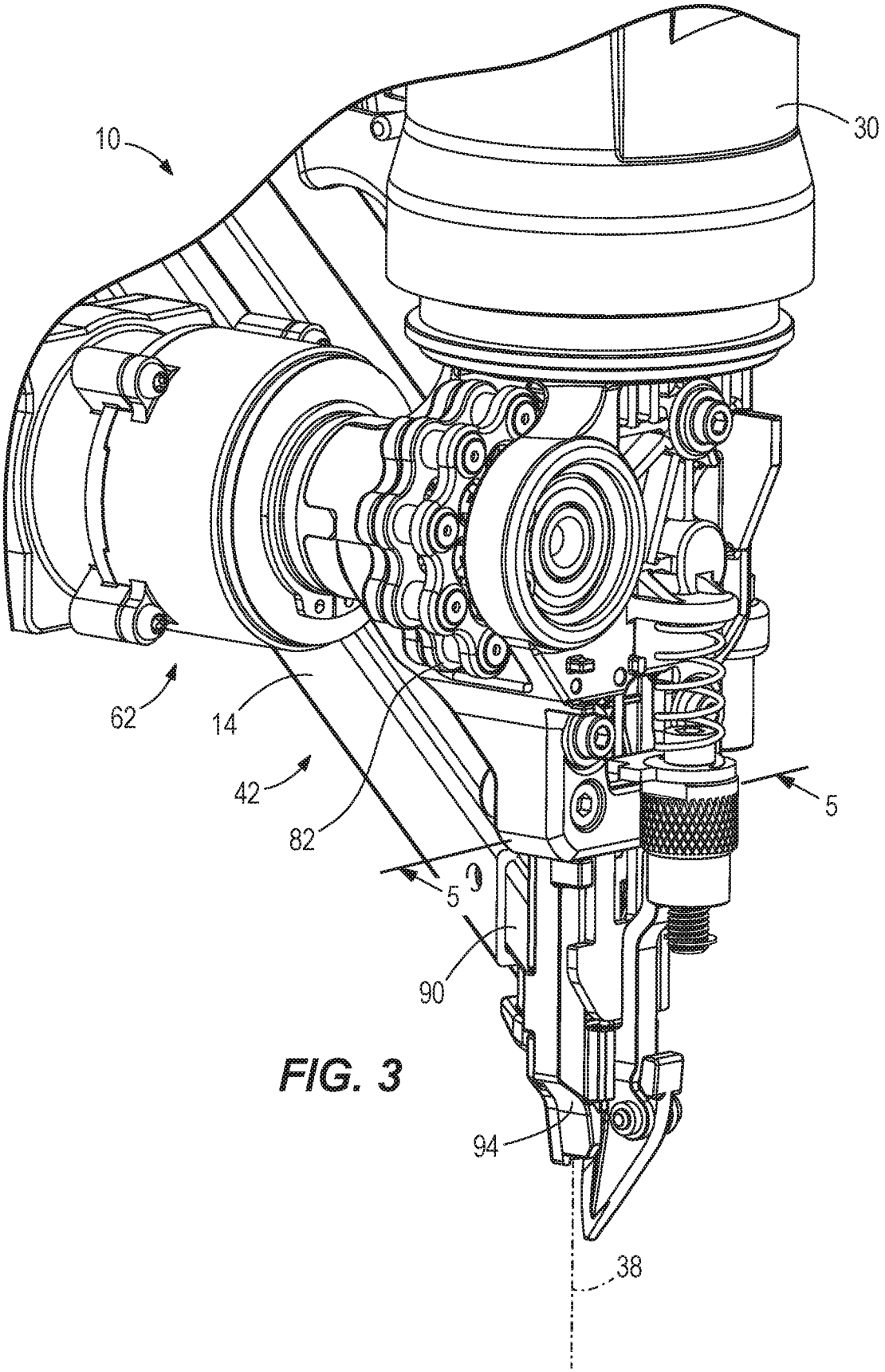
FIG. 3 is another partial cut-away view of the fastener driver of FIG. 1.
Figure 4:
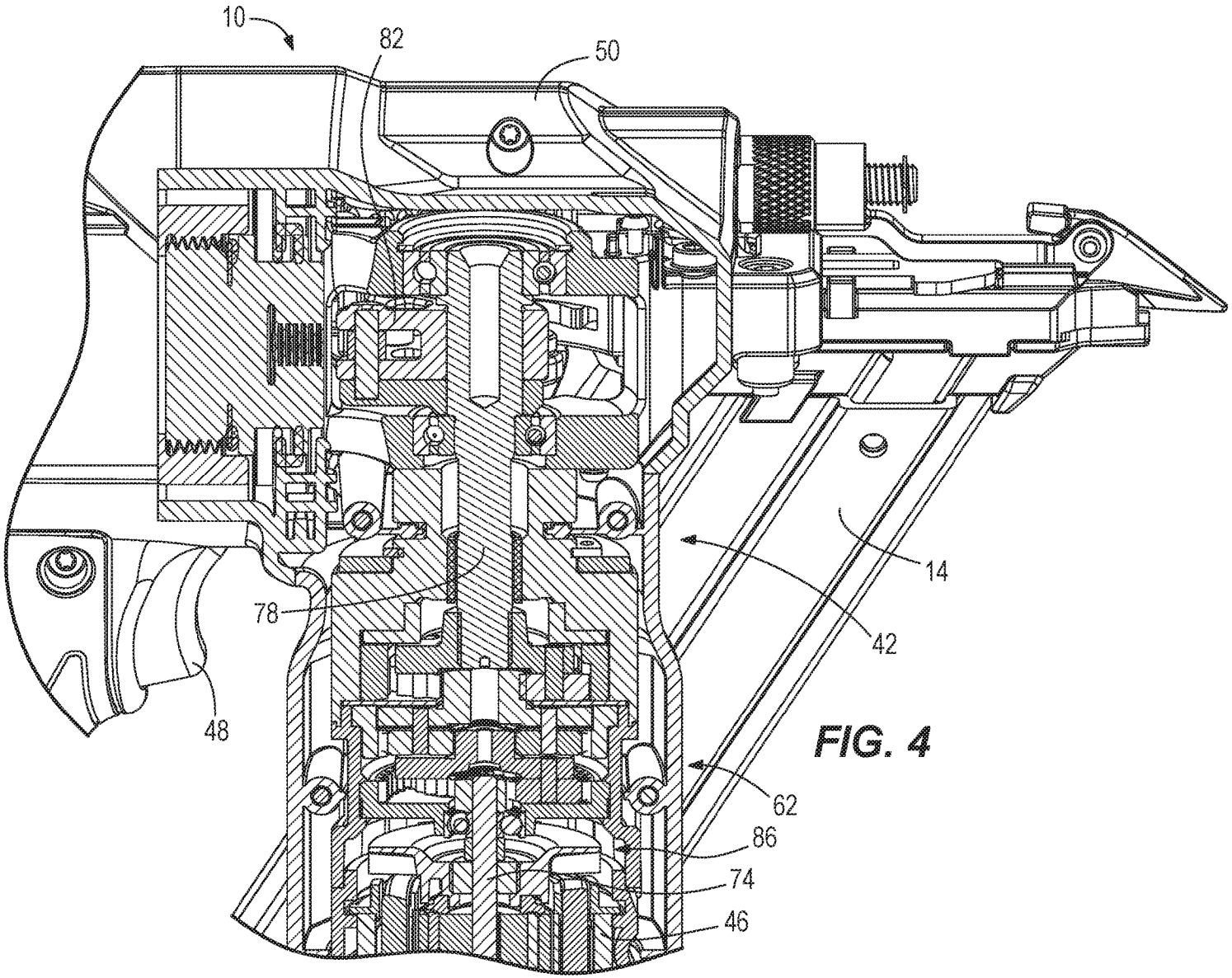
FIG. 4 is a cross-sectional view of the fastener driver of FIG. 1 taken along line 4-4 shown in FIG. 1, illustrating a motor, a transmission, and a fan assembly.

With reference to FIGS. 2 and 3, the fastener driver 10 includes a housing 50 formed from clamshell housing halves. The housing 50 includes a cylinder support portion 54 (FIG. 1) in which the storage chamber cylinder 30 is at least partially positioned, and a transmission housing portion 58 in which a transmission 62 is at least partially positioned. The transmission 62 is a component of the lifting assembly 42, which raises the driver blade 26 from the driven position to the ready position. With reference to FIG. 4, the motor 46 is also a component of the lifting assembly 42 and is coupled to the transmission housing portion 58 for providing torque to the transmission 62 when activated. A battery 66 (FIG. 1) is electrically connectable to the motor 46 for supplying electrical power to the motor 46. In alternative embodiments, the driver may be powered from an AC voltage input (i.e., from a wall outlet), or by an alternative DC voltage input (e.g., a DC power support).

With reference to FIG. 4, the transmission 62 rotatably couples to a motor output shaft 74, and includes a transmission output shaft 78 extending to a lifter 82 of the lifting assembly 42 (FIG. 3). The lifter 82 is operable to move the driver blade 26 from the driven position to the ready position. The transmission 62 provides torque to the lifter 82 from the motor 46. A fan 86 is rotatably coupled to the motor shaft 74 to generate cooling airflow within an interior of the fastener driver 10.

Figure 7:
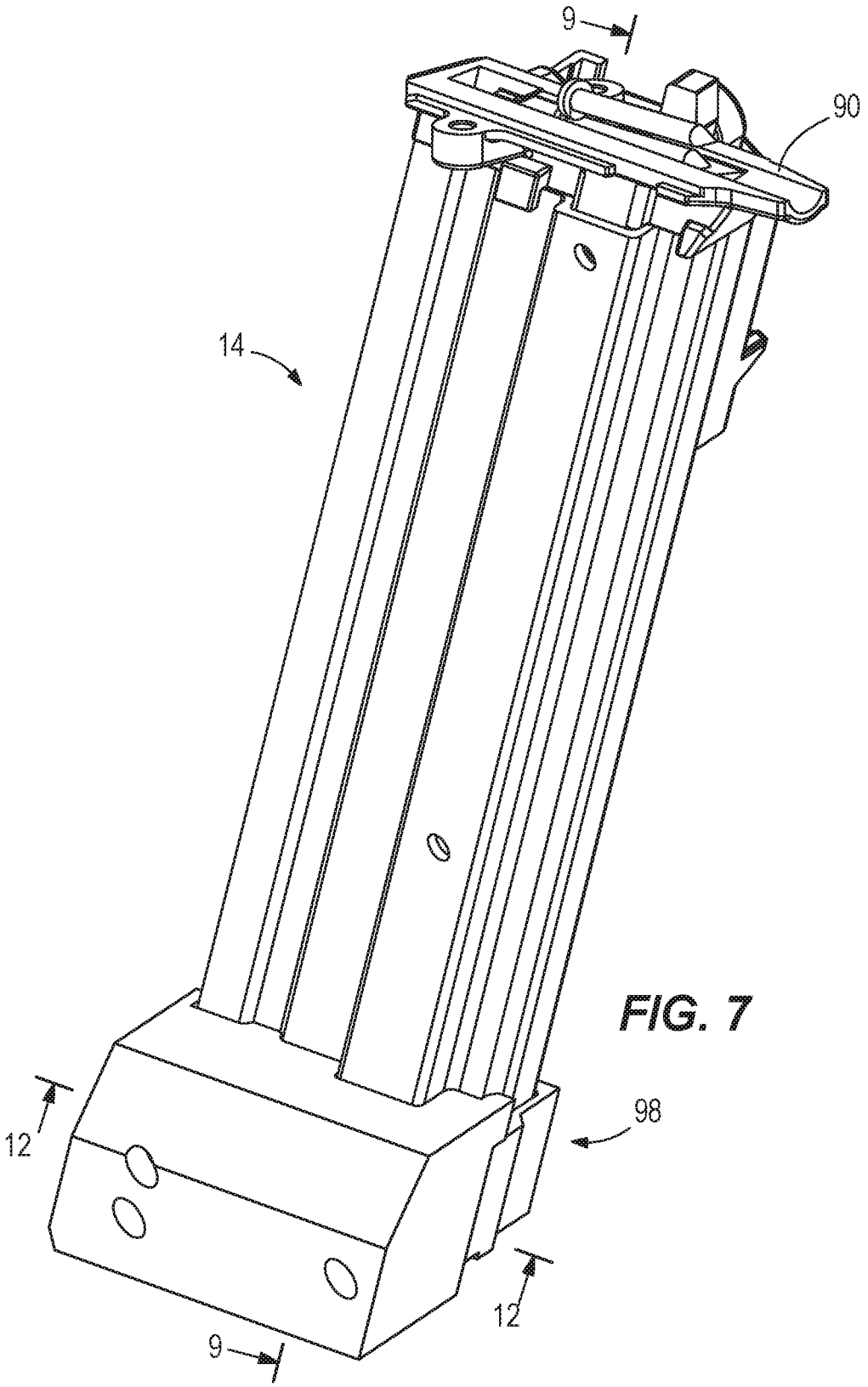
FIG. 7 is a perspective view of a magazine of the fastener driver of FIG. 1.
Figure 8:
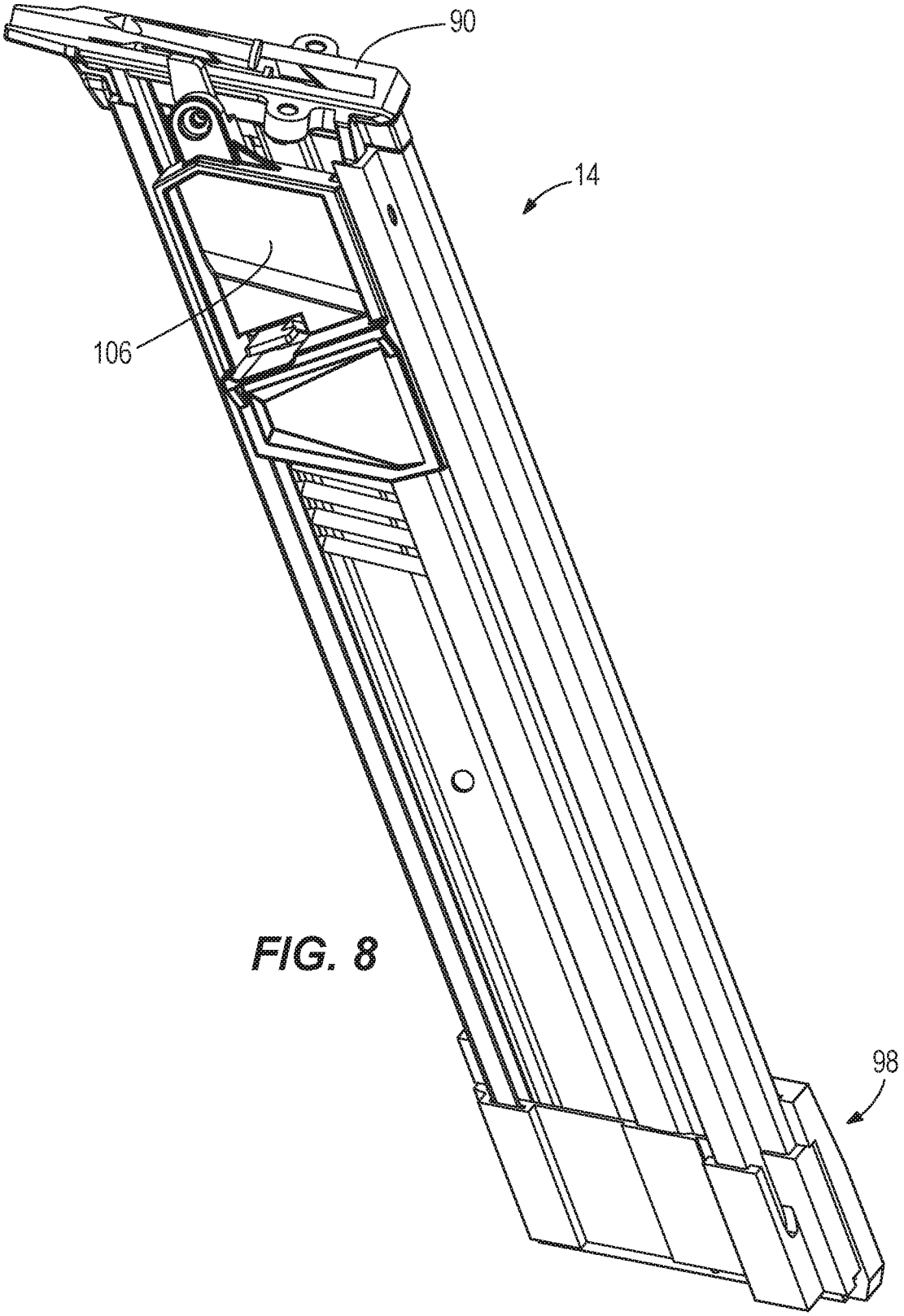
FIG. 8 is another perspective view of the magazine of FIG. 7.
Figure 9:
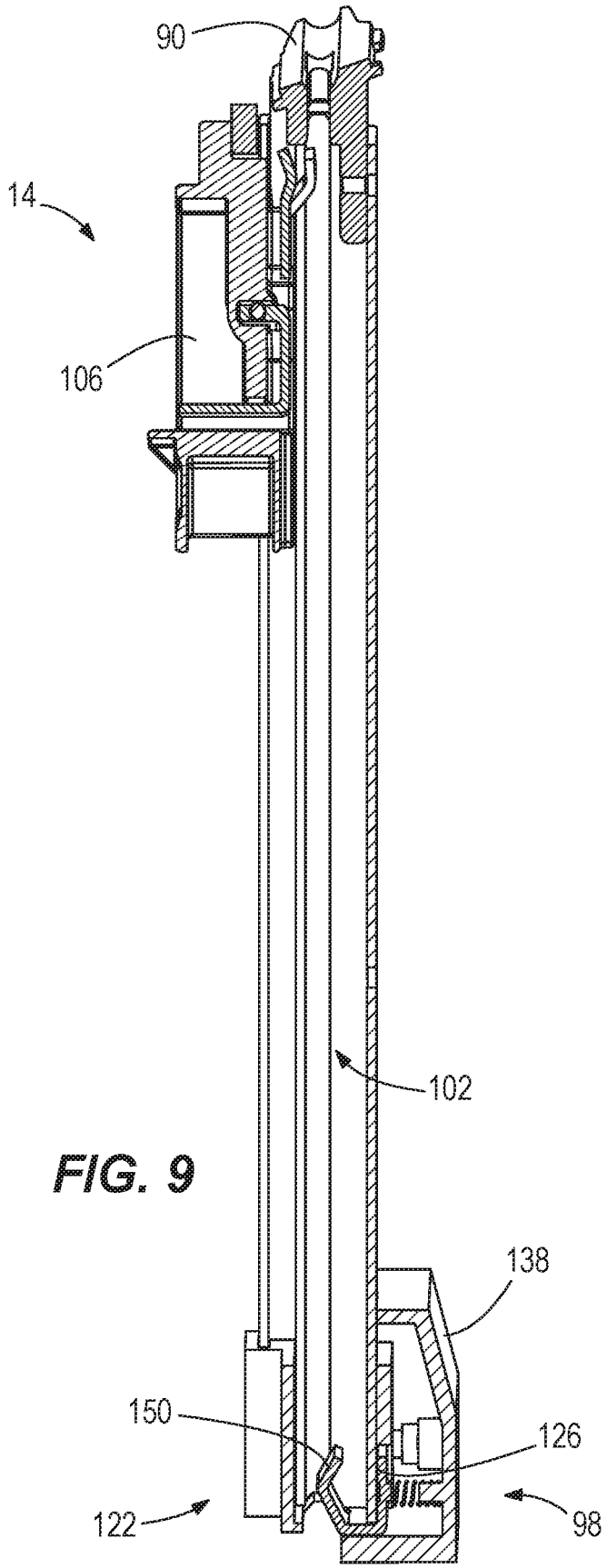
FIG. 9 is a cross-sectional view of the magazine of FIG. 7 taken along line 9-9 of FIG. 7.

With reference to FIGS. 7 and 8, the magazine 14 includes a shear block 90 at one end that is fastened to a nosepiece 94 (FIG. 3) of the fastener driver 10 to secure the magazine 14 to the fastener driver 10. The magazine 14 also includes a loading portion 98 at the opposite end that receives the nails 16*a*, 16*b* for loading into the magazine 14. The nails 16*a*, 16*b* enter through the loading portion 98 and advance into a feed channel 102 (FIG. 12) that extends within the magazine 14 from the loading portion 98 to the shear block 90. A pusher 106 is biased toward the shear block 90 and urges the loaded nails 16*a*, 16*b* toward the shear block 90.

Figure 12:
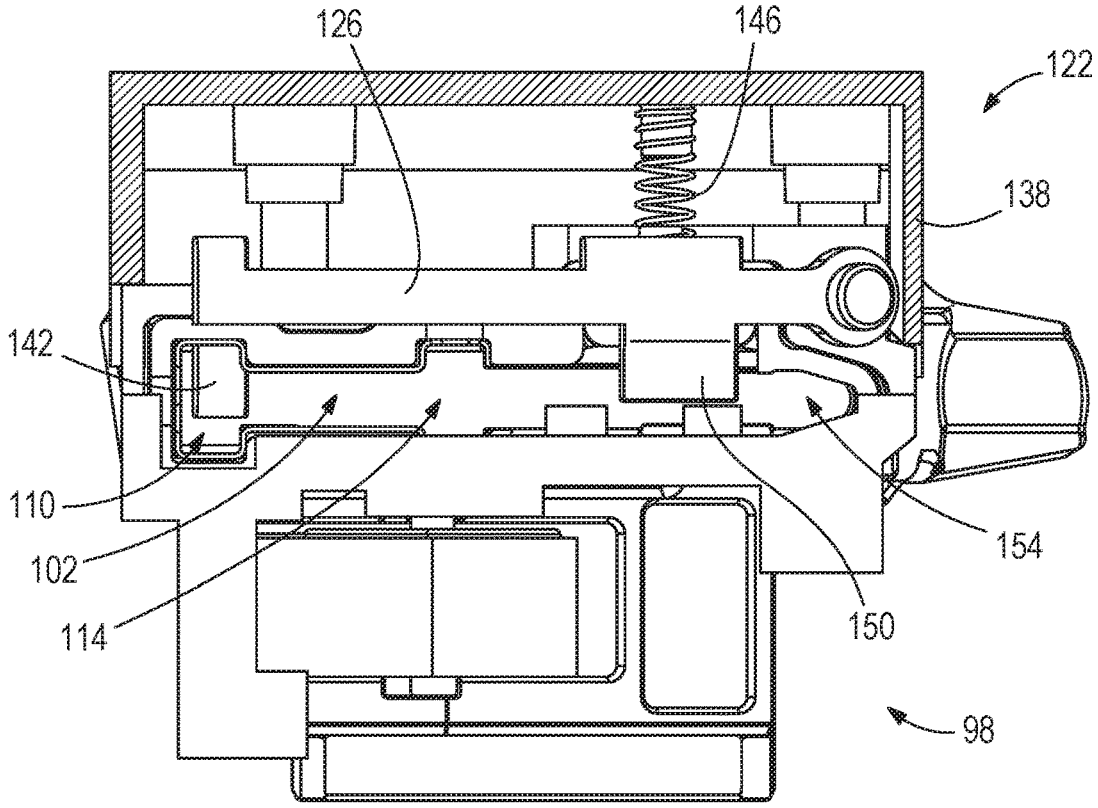
FIG. 12 is a cross-sectional view of the magazine of FIG. 7 taken along line 12-12 of FIG. 7.
Figure 13:
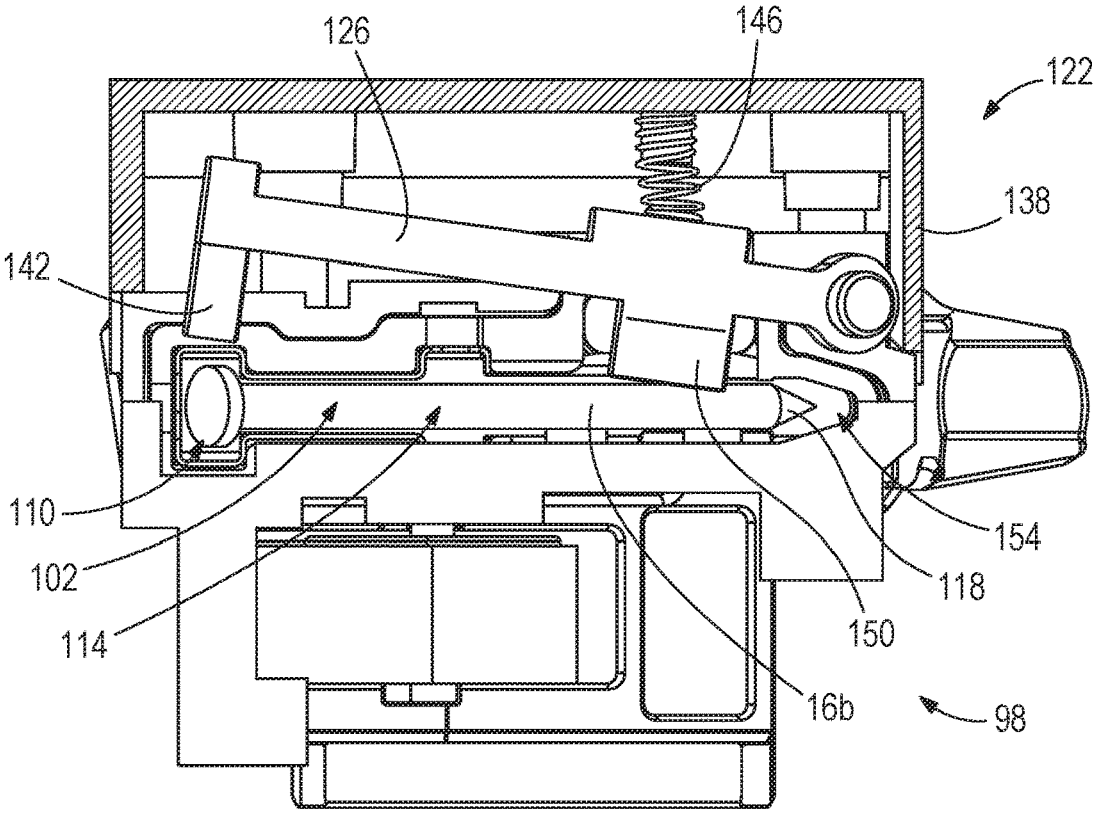
FIG. 13 is another cross-sectional view of the magazine of FIG. 7 illustrating a long nail inserted into a long nail slot.
Figure 14:
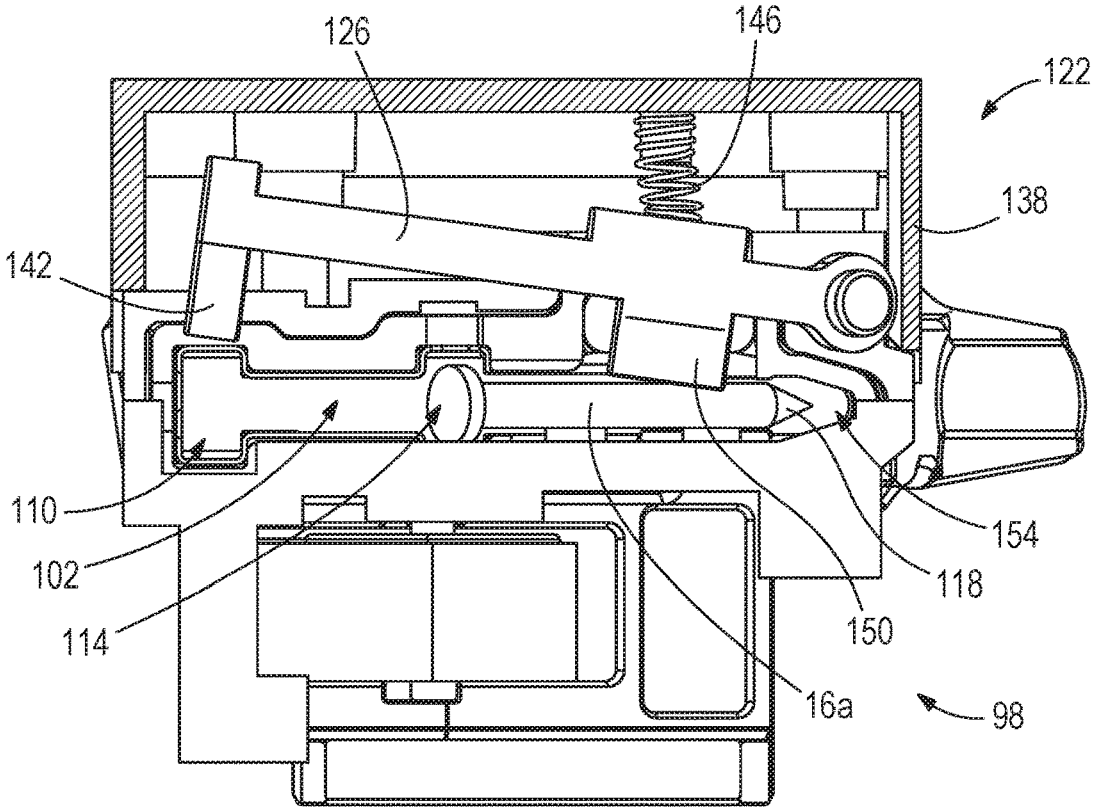
FIG. 14 is another cross-sectional view of the magazine of FIG. 7 illustrating a short nail inserted into a short nail slot.

With reference to FIGS. 12-14, the feed channel 102 includes a long nail slot 110 and a short nail slot 114, each configured to receive a respective long nail 16*b* (FIG. 13) or short nail 16*a* (FIG. 14). When properly loaded into a respective slot 110, 114, the short and long nails 16*a*, 16*b* will be loaded such that a tip portion 118 of either type is located in the same location relative to the driver blade 26 when the nail 16*a* or 16*b* is next to be fired.

Figure 10:
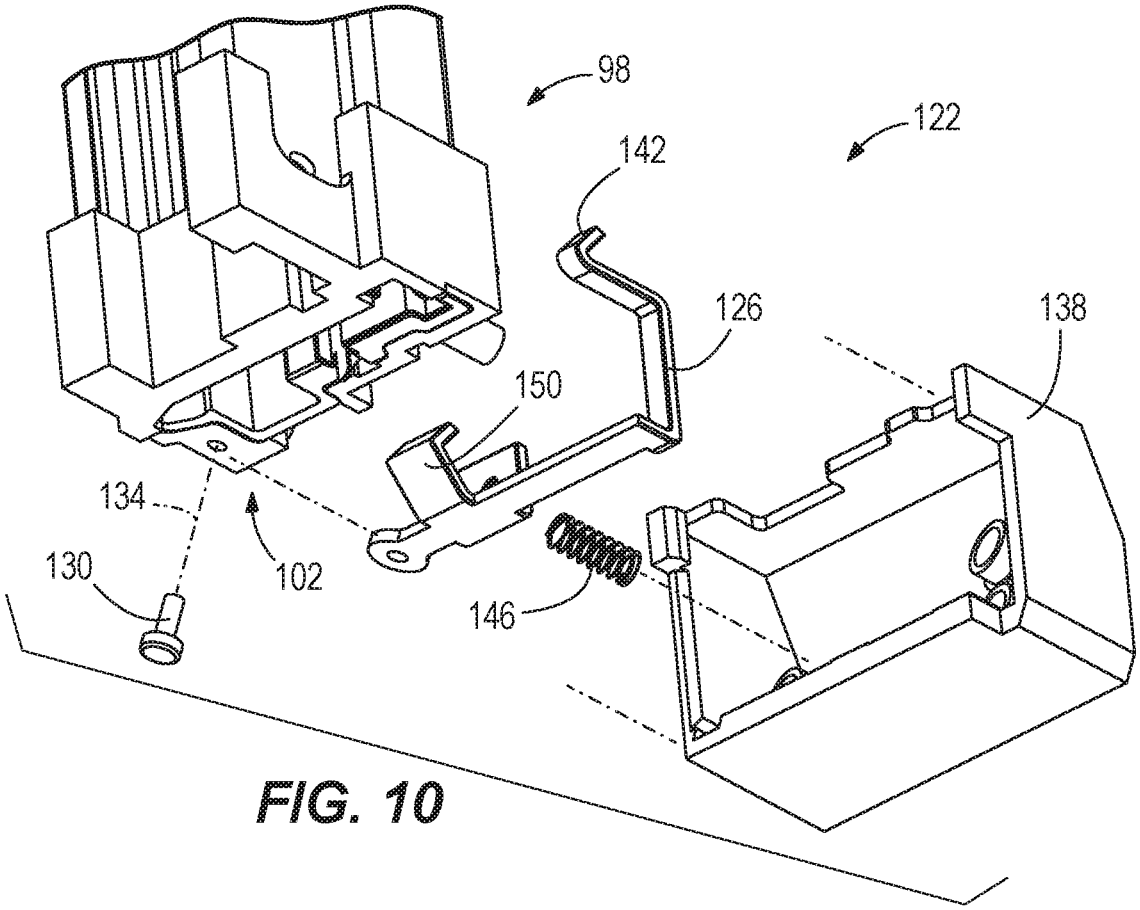
FIG. 10 is a partial exploded view of the magazine of FIG. 7 illustrating a feed channel access gate.
Figure 11:
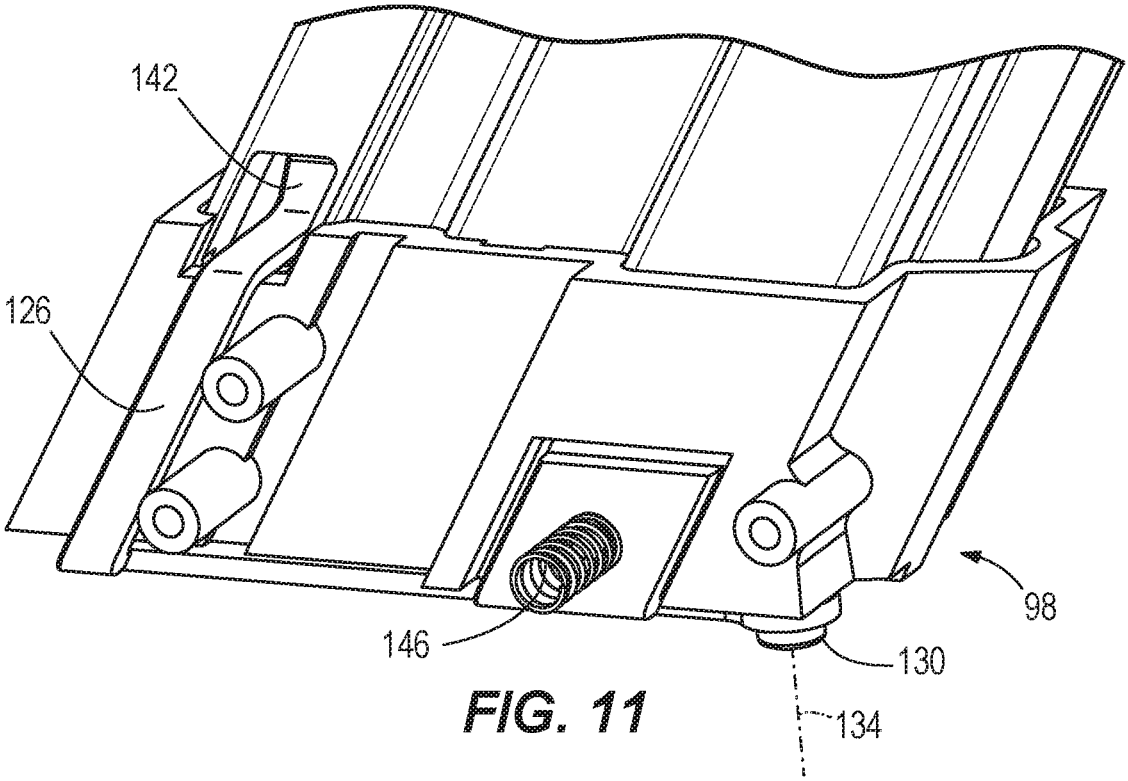
FIG. 11 is a partial cut-away view of the feed channel access gate of FIG. 10.

The loading portion 98 also includes a feed channel access gate 122 to prevent the short nails 16*a* from being improperly loaded into the long nail slot 110. The feed channel access gate 122 is configured as a pivot member 126 attached to the magazine 14 by a pin 130 and rotatable about a pivot axis 134 (FIG. 10). The pivot member 126 swings about the pivot axis 134 within a space enclosed by a bracket 138, between a blocking position (FIG. 12) and a bypass position (FIG. 13). The pivot member 126 includes a blocking tab 142, and the pivot member 126 is biased by a spring 146 toward the blocking position (FIG. 12) at which the blocking tab 142 occupies and obstructs a portion of the long nail slot 110.

The pivot member 126 also includes a ramp 150 located adjacent a forward end 154 of the feed channel 102. When the long nails 16*b* are loaded into the long nail slot 110 (FIG. 13), the tip portion 118 of the long nails 16*b* engages the ramp 150, causing the pivot member 126 to pivot toward the bypass position at which the blocking tab 142 vacates the long nail slot 110 and the long nails 16*b* are thus permitted to enter the feed channel 102. Likewise, when the short nails 16*a* are properly loaded into the short nail slot 114 (FIG. 14), the tip portion 118 of the short nails 16*a* engages the ramp 150, causing the pivot member 126 to pivot toward the bypass position such that the short nails 16*a* are permitted to enter the feed channel 102.

Figure 15:
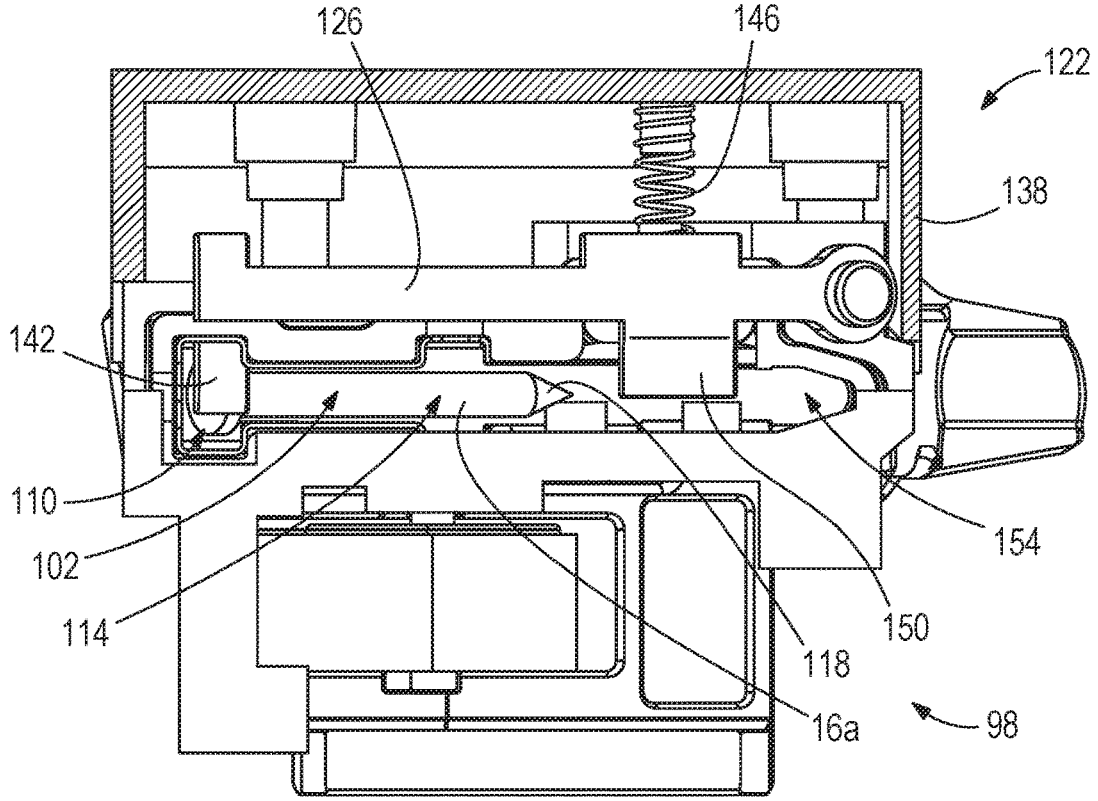
FIG. 15 is another cross-sectional view of the magazine of FIG. 7 illustrating a short nail inserted into a long nail slot.

FIG. 15 illustrates a scenario in which an attempt is made to improperly load the short nails 16*a* into the feed channel 102 via the long nail slot 110. When such an attempt is made, the tip portion 118 of the short nails 16*a* do not reach sufficiently far to engage the ramp 150 of the pivot member 126. Thus, the pivot member 126 remains in the blocking position at which the blocking tab 142 obstructs the long nail slot 110, and the short nails 16*a* cannot enter the feed channel 102. By preventing the short nails 16*a* from entering the feed channel 102 through the long nail slot 110, the feed channel access gate 122 reduces the number of jams that otherwise may result during operation of the fastener driver 10.

FIGS. 16-28 illustrate another magazine 214 having a feed channel access gate 322 according to another embodiment of the invention. The magazine 214 is similar to the magazine 14 and includes substantially the same structure as the magazine 14. Accordingly, the following description focuses primarily on the structure and features that are different from the embodiments described above in connection with FIGS. 1-15. Features and elements that are described in connection with FIGS. 1-15 are numbered in the 200 and 300 series of reference numerals in FIGS. 16-28. It should be understood that features of the magazine 214 that are not explicitly described below have the same properties as the features of the magazine 14.

Figure 16:
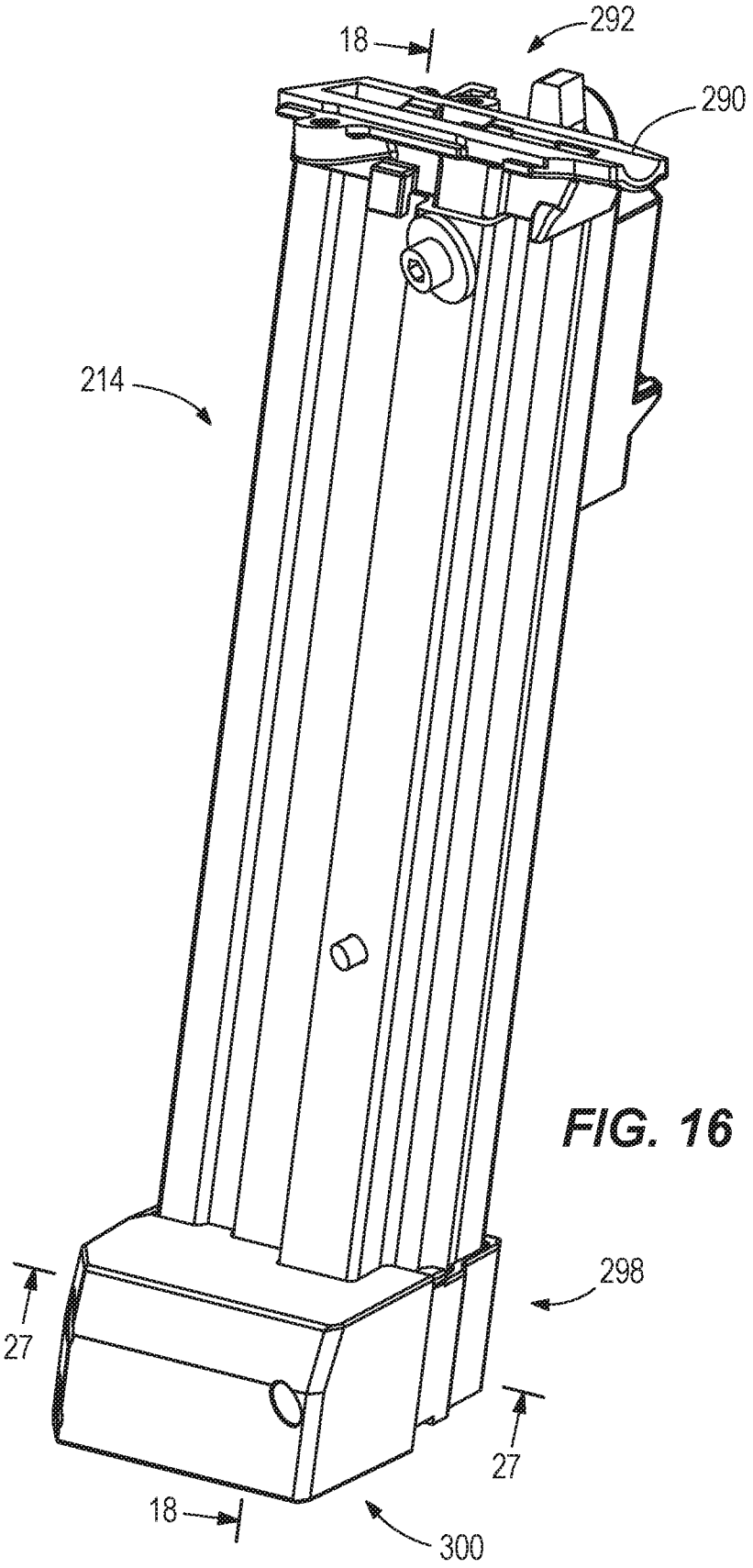
FIG. 16 is a perspective view of a magazine of the fastener driver of FIG. 1 according to another embodiment.
Figure 17:
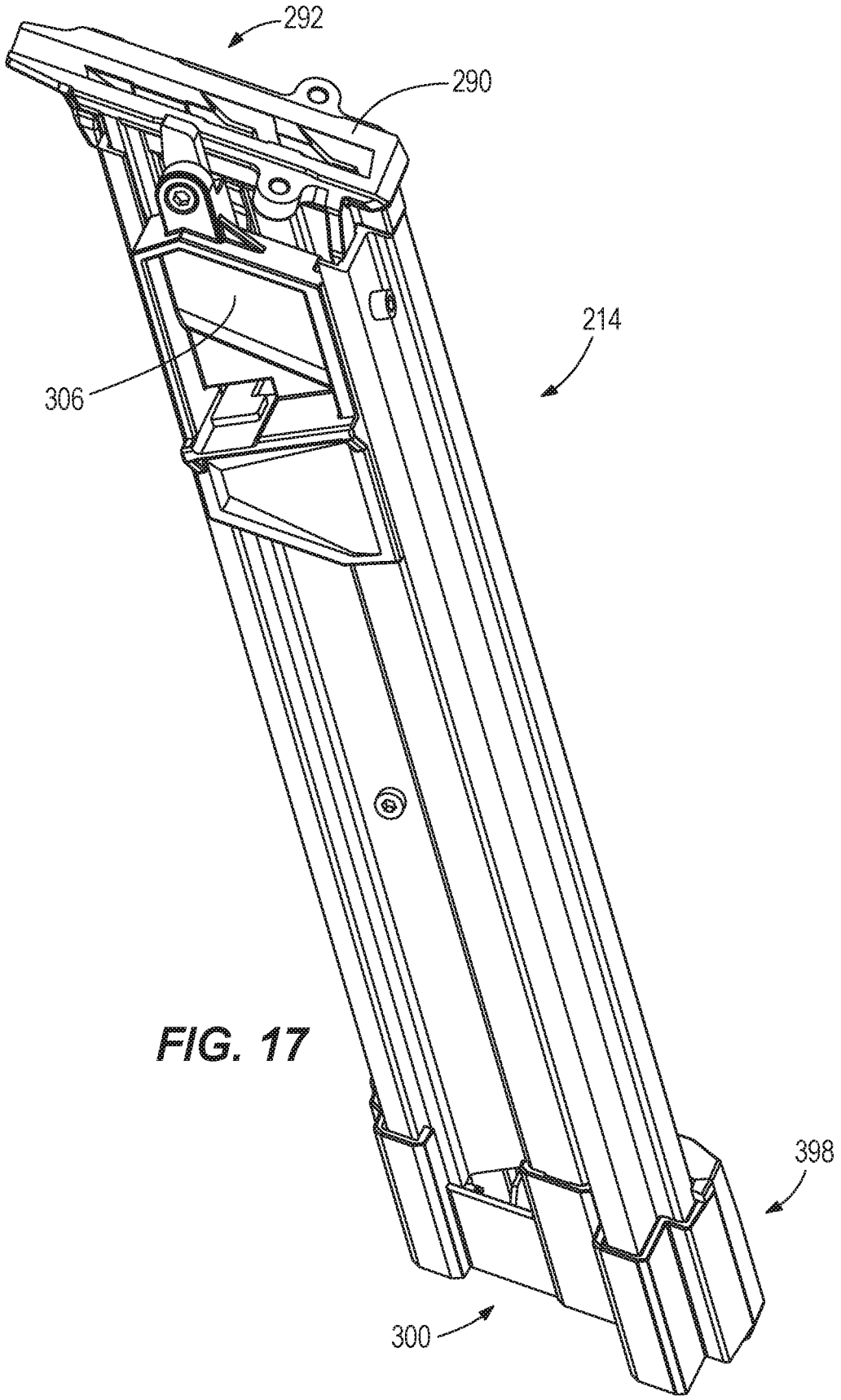
FIG. 17 is another perspective view of the magazine of FIG. 16.
Figure 18:
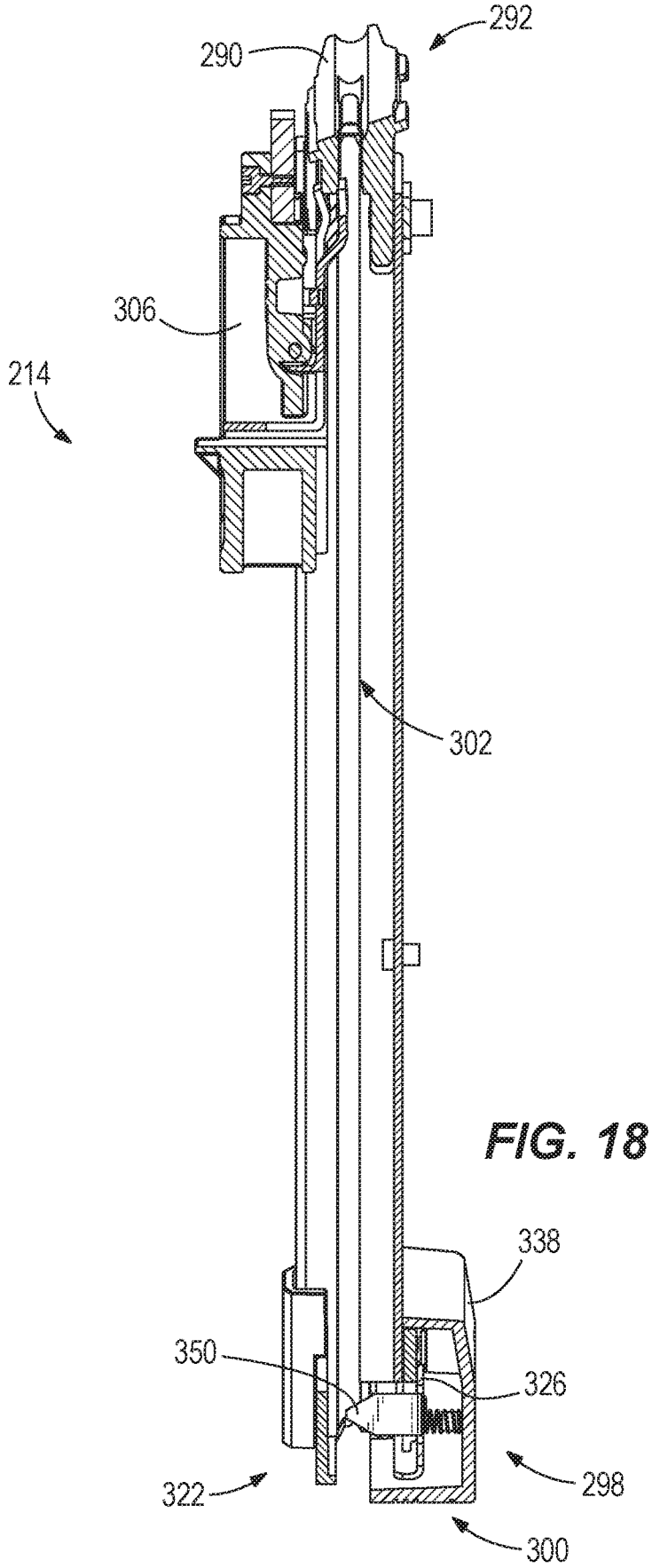
FIG. 18 is a cross-sectional view of the magazine of FIG. 16 taken along line 18-18 of FIG. 16.

With reference to FIG. 16, the magazine 214 includes a shear block 290 at a first end 292 that is fastened to the nosepiece 94 (FIG. 3) of the fastener driver 10 to secure the magazine 214 to the fastener driver 10. The magazine 214 also includes a loading portion 298 at an opposite second end 300 that receives the nails 16*a*, 16*b* for loading into the magazine 214. The nails 16*a*, 16*b* enter through the loading portion 298 and advance into a feed channel 302 (FIG. 21) that extends within the magazine 214 from the loading portion 298 to the shear block 290. A pusher 306 (FIG. 17) is biased toward the shear block 290 and urges the loaded nails 16*a*, 16*b* toward the shear block 290.

Figure 21:
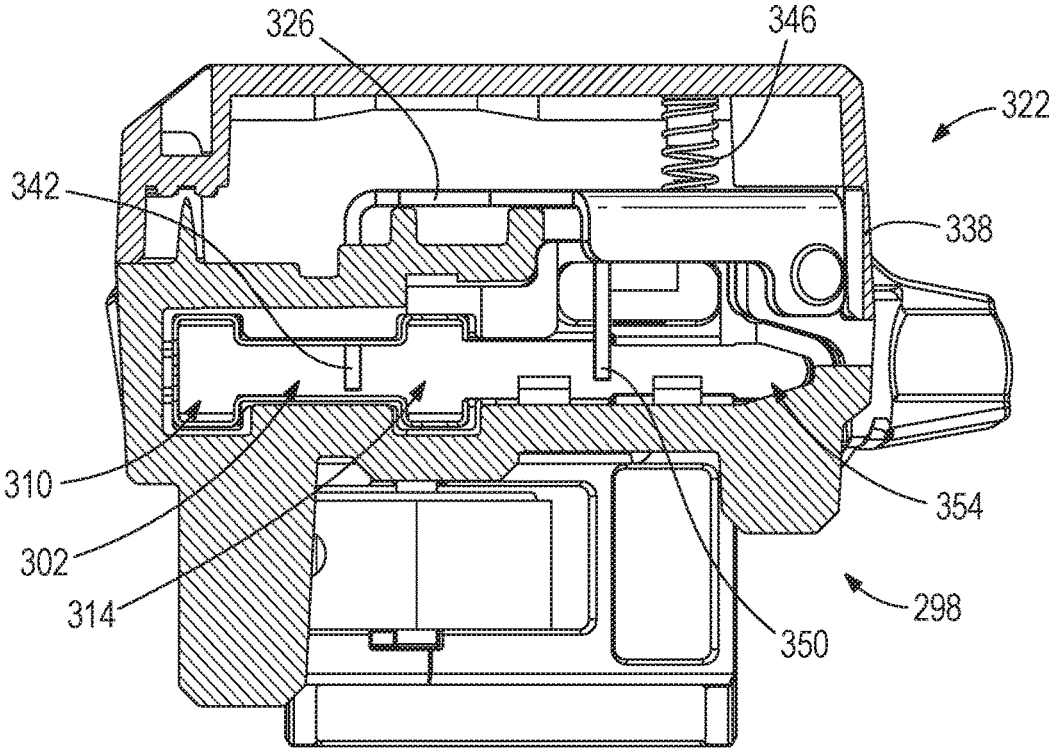
FIG. 21 is a cross-sectional view of the magazine of FIG. 16 taken along line 27-27 of FIG. 16, illustrating the pivot member in a blocking position.
Figure 22:
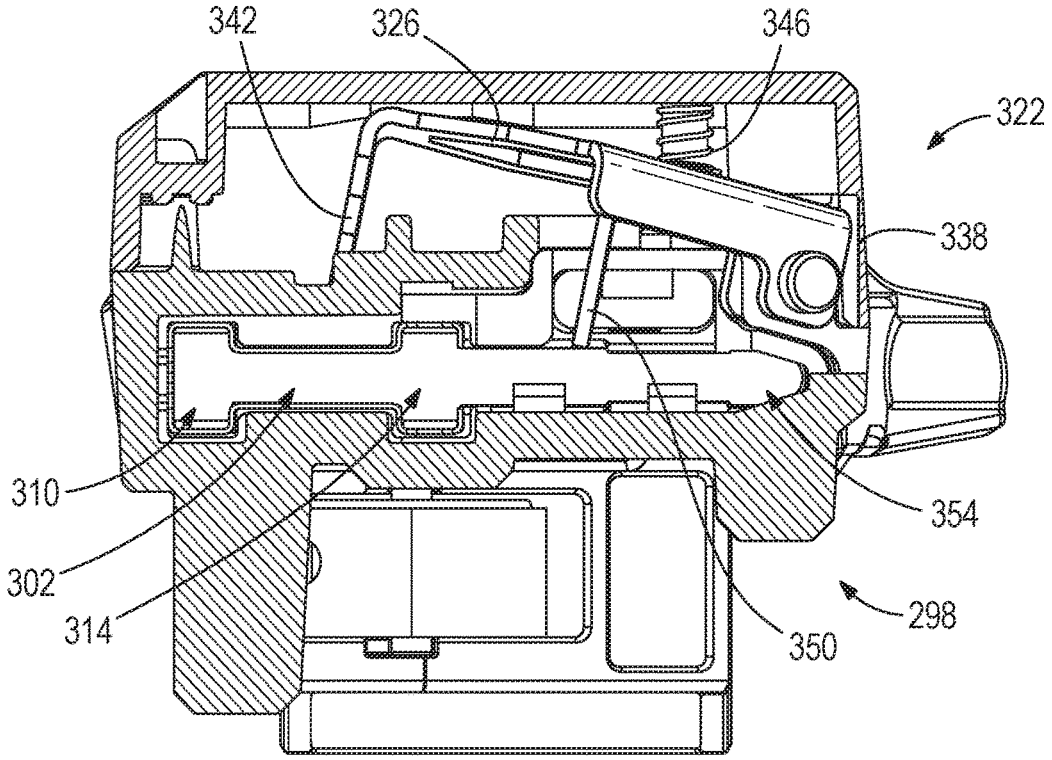
FIG. 22 is another cross-sectional view of the magazine of FIG. 16 illustrating the pivot member in a bypass position.

With reference to FIGS. 21 and 22, the feed channel 302 includes a long nail slot 310 and a short nail slot 314, each configured to receive the respective long or short nails 16*b*, 16*a* (FIGS. 13 and 14). When properly loaded into a respective slot 310, 314, the long and short nails 16*b*, 16*a* will be loaded such that the tip portion 118 (FIGS. 13 and 14) of either type is located in the same location relative to the driver blade 26 (FIG. 6) when the nail 16*a* or 16*b* is next to be fired.

Figure 19:
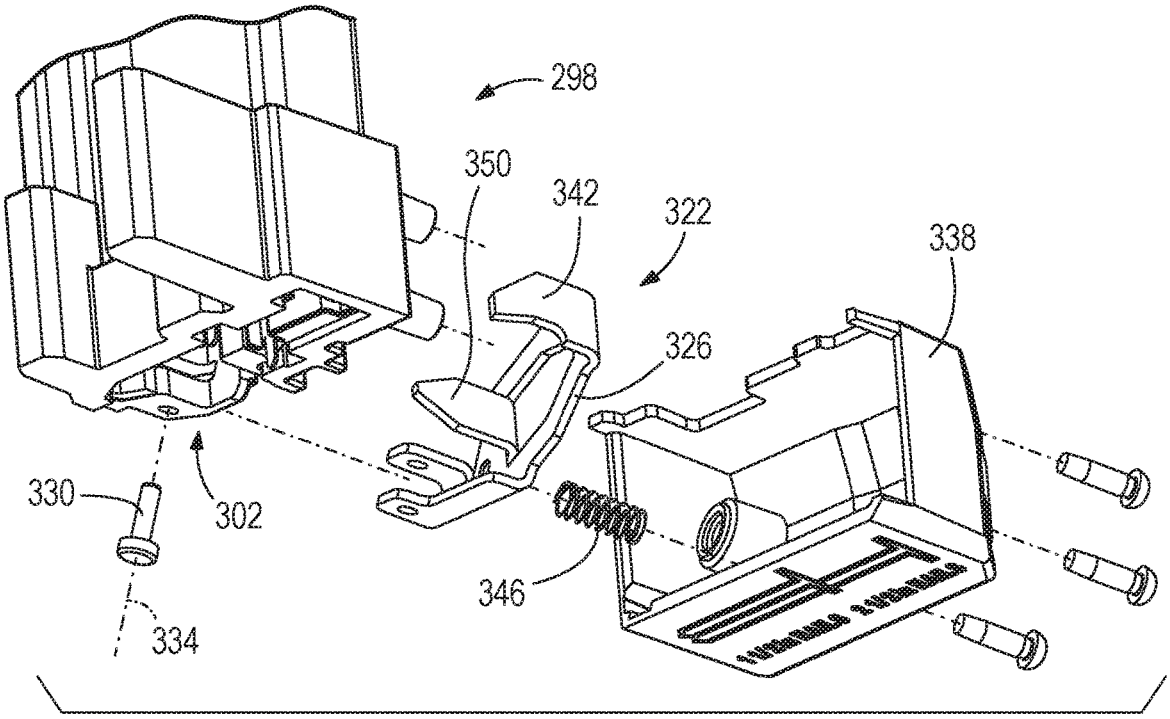
FIG. 19 is a partial exploded view of the magazine of FIG. 16 illustrating a feed channel access gate that includes a pivot member.
Figure 20:
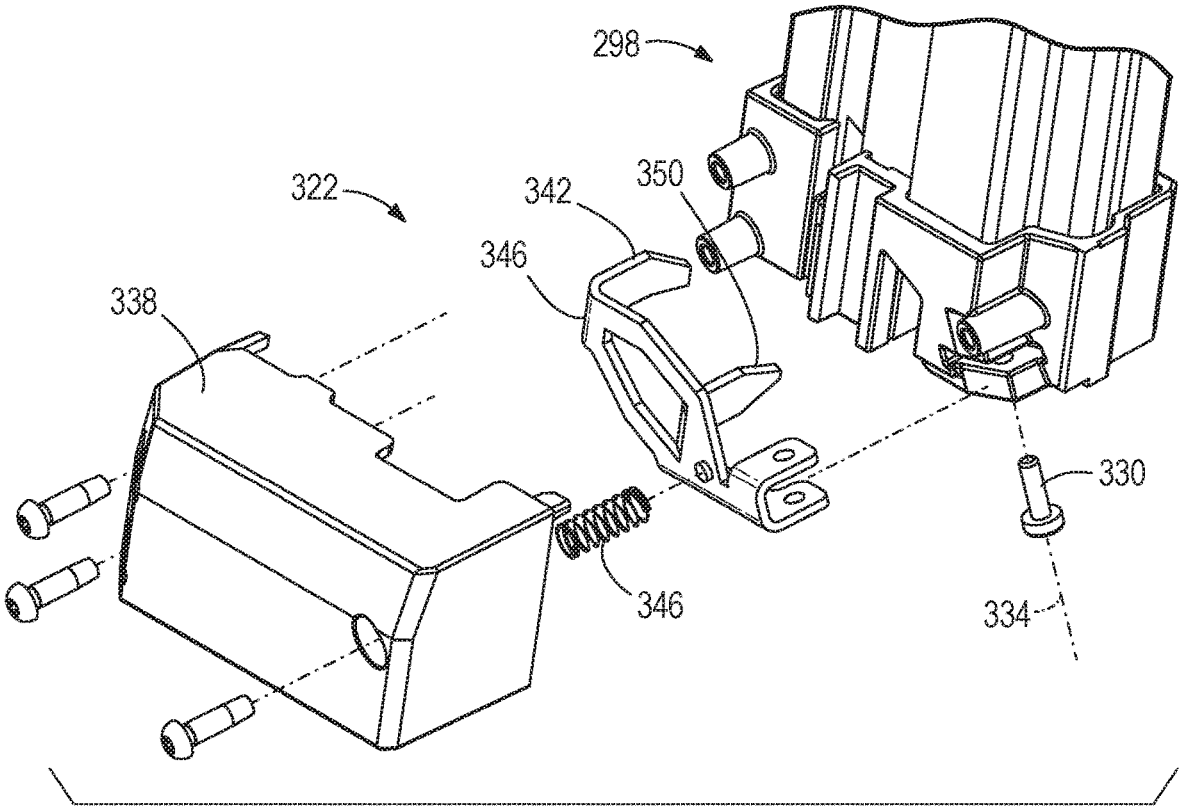
FIG. 20 is another partial exploded view of the magazine of FIG. 16.

The loading portion 298 also includes a feed channel access gate 322 to prevent the short nails 16*a* from being improperly loaded into the long nail slot 310. The feed channel access gate 322 is configured as a pivot member 326 attached to the magazine 214 by a pin 330 and rotatable about a pivot axis 334 (FIG. 19). The pivot member 326 swings about the pivot axis 334 within a space enclosed by a bracket 338, between a blocking position (FIG. 21) and a bypass position (FIG. 22). The pivot member 326 includes a blocking tab 342, and the pivot member 326 is biased by a spring 346 toward the blocking position (FIG. 21) at which the blocking tab 342 occupies and obstructs a portion of the long nail slot 310. The pivot member 326 also includes a ramp 350 located adjacent a forward end 354 of the feed channel 302.

The feed channel access gate 322 operates in a manner similar to that described above with regard to FIGS. 13-14. When the long nails 16*b* are loaded into the long nail slot 310 (see FIG. 13), the tip portion 118 of the long nails 16*b* engages the ramp 350, causing the pivot member 326 to pivot toward the bypass position at which the blocking tab 342 vacates the long nail slot 310 and the long nails 16*b* are thus permitted to enter the feed channel 302. Likewise, when the short nails 16*a* are properly loaded into the short nail slot 314 (see FIG. 14), the tip portion 118 of the short nails 16*a* engages the ramp 350, causing the pivot member 326 to pivot toward the bypass position such that the short nails 16*a* are permitted to enter the feed channel 302. When an attempt is made to improperly load the short nails 16*a* into the feed channel 302 via the long nail slot 310 (see FIG. 15), the tip portion 118 of the short nails 16*a* does not reach sufficiently far to engage the ramp 350 of the pivot member 326. Thus, the pivot member 326 remains in the blocking position at which the blocking tab 342 obstructs the long nail slot 310, and the short nails 16*a* cannot enter the feed channel 302. By preventing the short nails 16*a* from entering the feed channel 302 through the long nail slot 310, the feed channel access gate 322 reduces the number of jams that otherwise may result during operation of the fastener driver 10.

FIGS. 23-28 illustrate the pivot member 326 in greater detail. The pivot member 326 may be manufactured from a blank sheet of material (e.g., metal) that is subjected to a stamping and forming process. The pivot member 326 is formed having a shape that is generally easier to manufacture than that of the pivot member 126 described above.

Figure 23:
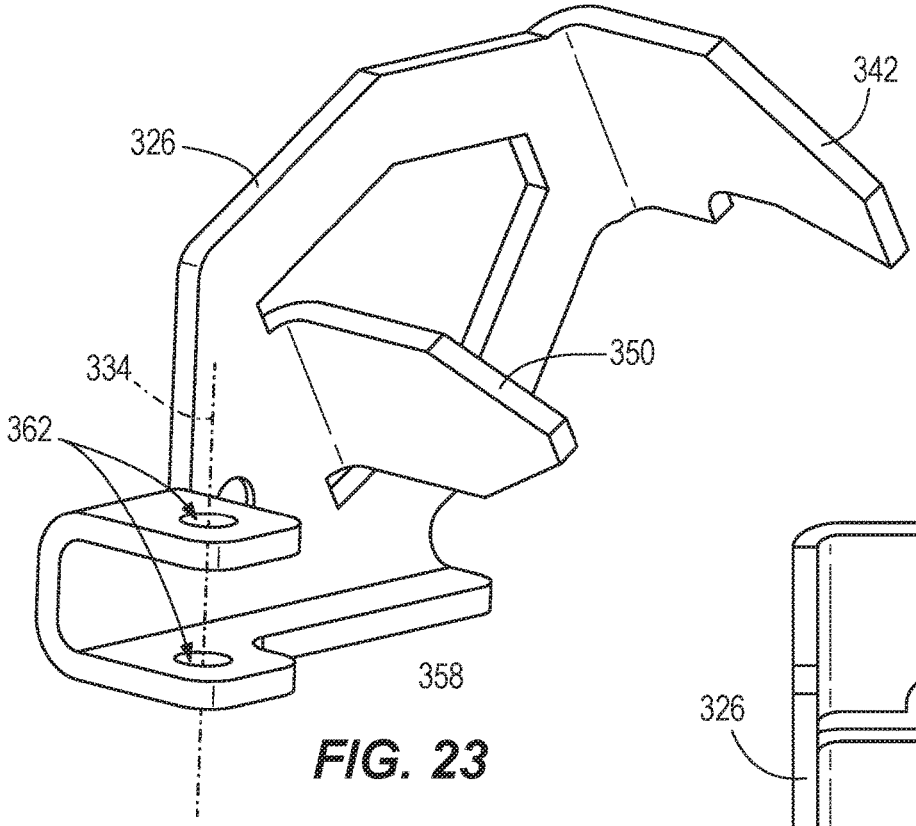
FIG. 23 is a perspective view of the pivot member of FIG. 19.
Figure 24:
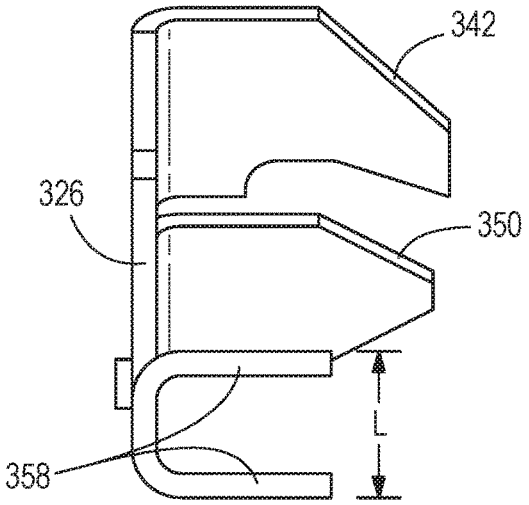
FIG. 24 is a side view of the pivot member of FIG. 19.
Figure 25:
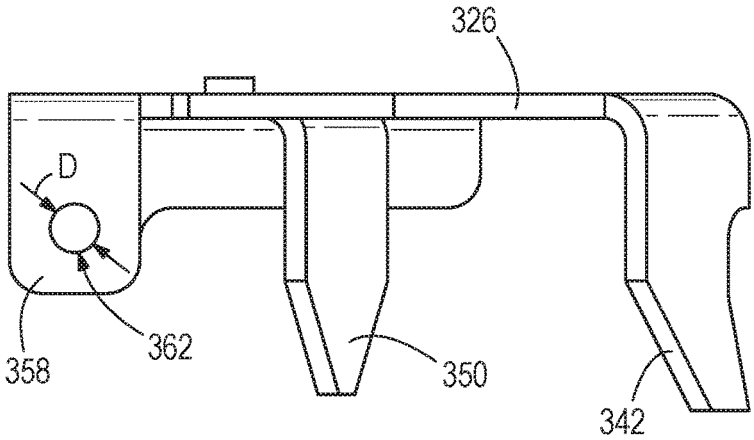
FIG. 25 is a top view of the pivot member of FIG. 19.

With reference to FIGS. 23-25, the pivot member 326 includes a pair of parallel pivot arms 358 that each define a respective pivot aperture 362. Each pivot aperture 362 is centered about the pivot axis 334 and cooperates to receive the pin 330. The pivot arms 358 are separated from one another by a distance L (FIG. 24), and each pivot aperture includes a diameter D (FIG. 25). In the illustrated embodiment, a ratio of the distance L to the diameter D is greater than 1.5 (i.e., LID>1.5). An L/D ratio greater than 1.5 generally prevents against binding or window locking as the pivot member 326 pivots about the pivot axis 334, thus providing better support and smoother operation.

Figure 26:
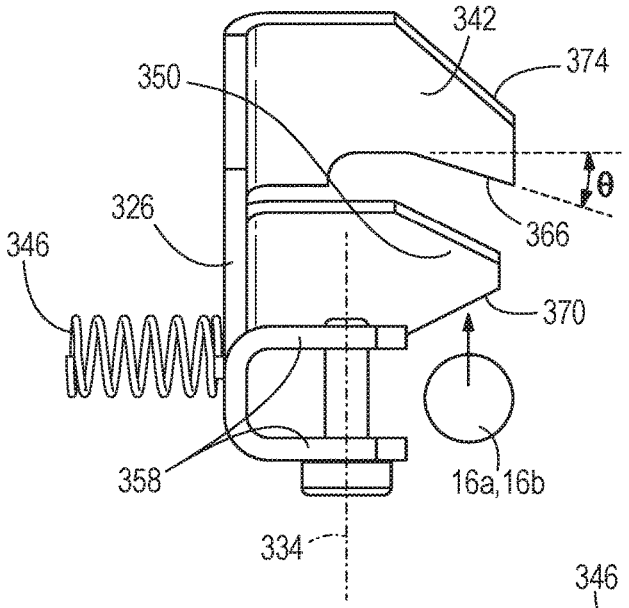
FIG. 26 is another side view of the pivot member of FIG. 19.

With reference to FIG. 26, the blocking tab 342 includes an inclined portion 366 inclined generally toward the pivot axis 334 and toward the second end 300 (FIG. 16) of the magazine 214. As the nails 16*a*, 16*b* are inserted into the magazine 214 along the feed direction indicated by the arrow in FIG. 26, the nails 16*a*, 16*b* perceive an inclined angle θ measured generally between the inclined portion 366 and the pivot arm 358. The inclined portion 366 causes the pivot member 326 to move further toward the blocking position (FIG. 21) if the short nails 16*a* are inserted into the long nail slot 310. The inclined portion 366 further helps to prevent the blocking tab 342 from failing due to wear.

Figure 27:
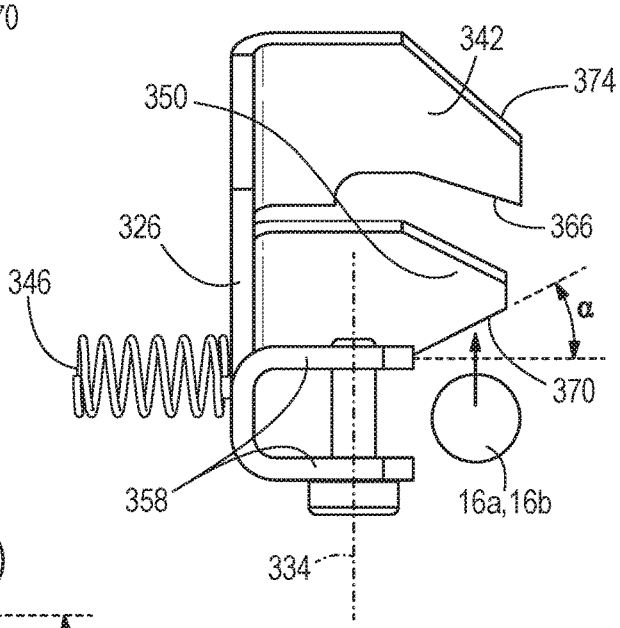
FIG. 27 is another side view of the pivot member of FIG. 19.

With reference to FIG. 27, the ramp 350 includes a first chamfer 370 inclined generally away from the pivot axis 334 and away from the second end 300 (FIG. 16) of the magazine 214. As the nails 16*a*, 16*b* are inserted into the magazine 214 along the feed direction indicated by the arrow in FIG. 27, the nails 16*a*, 16*b* perceive a first chamfer angle α measured generally between the first chamfer 370 and the pivot arm 358. The first chamfer 370 causes the pivot member 326 to move toward the bypass position (FIG. 22) upon contact with the nails 16*a*, 16*b*. The first chamfer angle α allows a nail insertion force to be minimal but greater than one pound (i.e., 1 lbf).

Figure 28:
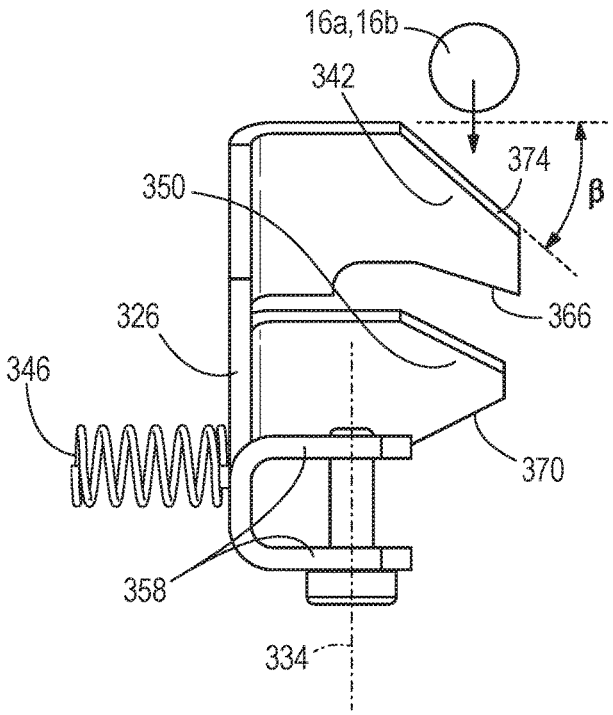
FIG. 28 is another side view of the pivot member of FIG. 19.

With reference to FIG. 28, the blocking tab 342 includes a second chamfer 374 that is inclined generally toward the pivot axis 334 and toward the second end 300 (FIG. 16) of the magazine 214. When the nails 16*a*, 16*b* are removed from the magazine 214 along a direction opposite to the feed direction as indicated by the arrow in FIG. 28 (e.g., to switch between short and long nails for different applications), the nails 16*a*, 16*b* perceive a second chamfer angle β measured generally between the second chamfer 374 and the pivot arm 358. The second chamfer 374 causes the pivot member 326 to move toward the bypass position (FIG. 22) upon contact with the nails 16*a*, 16*b*. In the illustrated embodiment, the second chamfer angle β is greater than the first chamfer angle α, thereby allowing the nails 16*a*, 16*b* to be removed from the magazine 214 with minimal force required.

Figure 29:
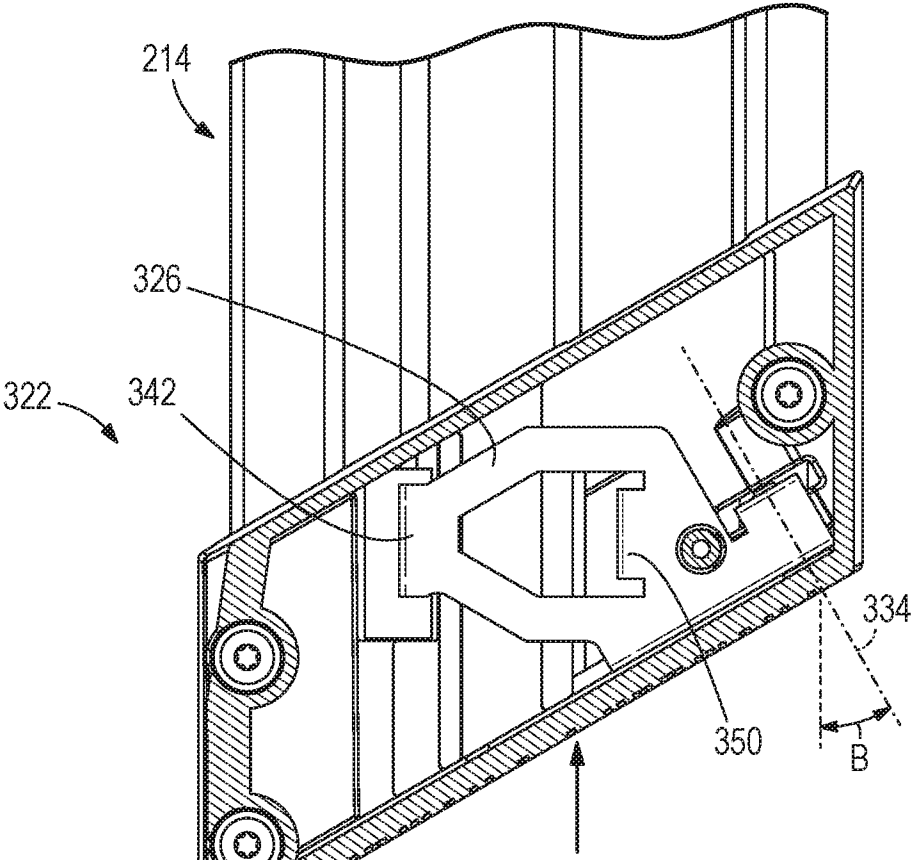
FIG. 29 is a partial cutaway view of the magazine of FIG. 16.

With reference to FIG. 29, the pivot axis 334 is inclined relative to the feed direction indicated by the arrow in FIG. 29. A pivot axis angle B is measured generally between the pivot axis 334 and the feed direction. In the illustrated embodiment, the pivot axis angle B measures approximately 30 degrees. In other embodiments, the pivot axis angle may measure more or less than 30 degrees (e.g., between 5 and 60 degrees), so that the pivot axis 334 is more or less inclined relative to the feed direction.

When the pivot member 326 rotates about the pivot axis 334 from the blocking position (FIG. 21) to the bypass position (FIG. 22), the inclination of the pivot axis 334 causes the blocking tab 342 and the ramp 350 to move slightly downward (i.e., in a direction opposite the feed direction) as the blocking tab 342 and the ramp 30 vacate the feed channel 302. The downward motion of the blocking tab 342 and the ramp 350 can cause self-locking (i.e. jamming) of the pivot member 326 when the nails 16*a*, 16*b* are inserted into the magazine 214. In other embodiments, the pivot axis 334 may be inclined in the opposite way, which can cause self-locking of the pivot member 326 when the nails 16*a*, 16*b* are removed from the magazine.

Figure 30:
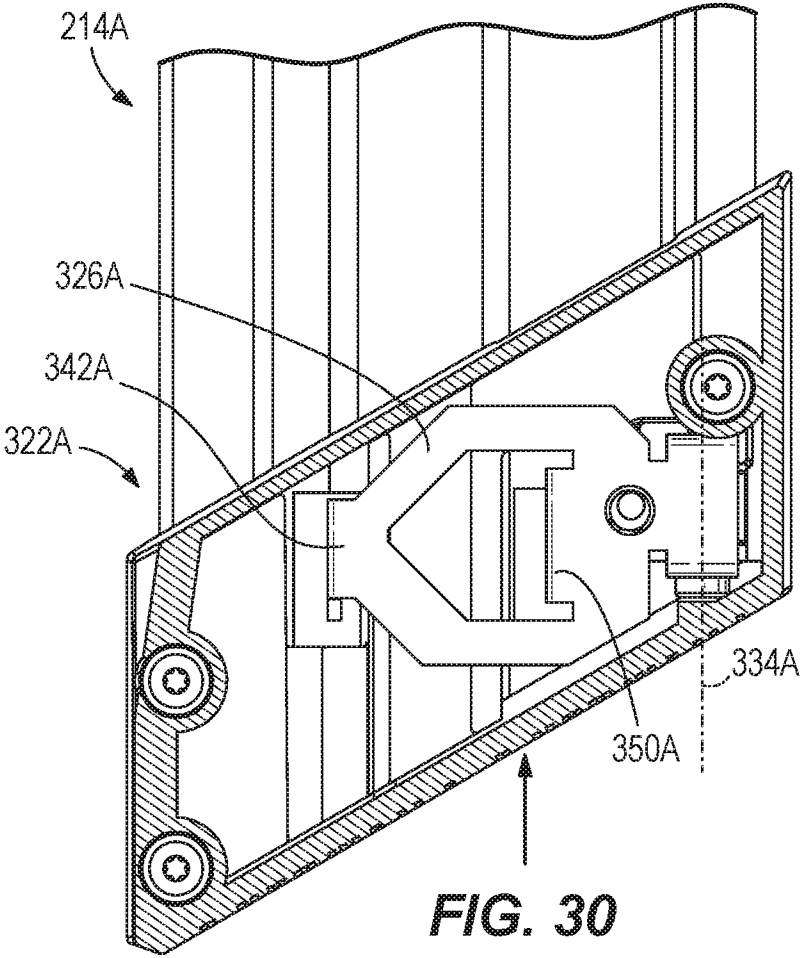
FIG. 30 is a partial cutaway view of a magazine of the fastener driver of FIG. 1 according to another embodiment.

FIG. 30 illustrates another magazine 214A having a feed channel access gate 322A according to another embodiment of the invention. The magazine 214A is similar to the magazine 214 and includes substantially the same structure as the magazine 214. The magazine 214A differs from the magazine 214 in that the magazine 214A includes a pivot member 326A rotatable about a pivot axis 334A oriented parallel to the feed direction indicated by the arrow in FIG. 30. Because the pivot axis 334A is parallel to the feed direction, the blocking tab 342A and the ramp 350A move in and out of the magazine 214A (i.e., in and out of the page in FIG. 30) and do not have a downward (i.e., in a direction opposite the feed direction) component of motion. This prevents the pivot member 326A from self-locking when the nails 16*a*, 16*b* are inserted into the magazine 214A, or when the nails 16*a*, 16*b* are removed from the magazine 214A.

Although the invention has been described in detail with reference to certain preferred embodiments, variations and modifications exist within the scope and spirit of one or more independent aspects of the invention as described.

What is claimed is:

1. A powered fastener driver comprising:

a magazine in which fasteners of a first length or fasteners of a second length greater than the first length are receivable, the magazine including a shear block located at a first end of the magazine, a loading portion located at a second end of the magazine opposite the first end, and a feed channel extending lengthwise through the magazine between the shear block and the loading portion;

wherein the loading portion of the magazine includes a first slot and a second slot that are each configured to receive fasteners of the corresponding first and second lengths for entry into the feed channel, and a feed channel access gate configured to prevent fasteners of the first length from being loaded into the second slot;

wherein the feed channel access gate is configured as a pivot member pivotable about a pivot axis between a first, blocking position blocking access to the second slot and a second, bypass position permitting access to the second slot; and wherein the powered fastener driver further comprises a spring formed separately from the pivot member that biases the pivot member toward the blocking position.

2. The powered fastener driver of claim 1, wherein the pivot member includes a blocking tab configured to obstruct a portion of the second slot when the pivot member is in the blocking position.

3. The powered fastener driver of claim 2, wherein the blocking tab includes an inclined portion inclined toward the second end of the magazine and configured to move the pivot member further toward the blocking position when a fastener of the first length is loaded into the second slot.

4. The powered fastener driver of claim 2, wherein the pivot member includes a ramp configured to engage a tip of the fasteners of the first length or a tip of the fasteners of the second length.

5. The powered fastener driver of claim 4, wherein when a fastener of the first length is inserted into the first slot, the tip of the fastener of the first length engages the ramp and moves the pivot member to the bypass position.

6. The powered fastener driver of claim 5, wherein when a fastener of the second length is inserted into the second slot, the tip of the fastener of the second length engages the ramp and moves the pivot member to the bypass position.

7. The powered fastener driver of claim 4, wherein when a fastener of the first length is inserted into the second slot, the tip of the fastener of the first length does not engage the ramp and the pivot member remains in the blocking position.

8. The powered fastener driver of claim 4, wherein the ramp includes a first chamfer inclined away from the second end of the magazine by a first chamfer angle.

9. The powered fastener driver of claim 8, wherein the blocking tab includes a second chamfer inclined toward the second end of the magazine by a second chamfer angle that is greater than the first chamfer angle; and wherein the second chamfer is configured to move the pivot member to the bypass position by engagement with the tip of one of the fasteners of the first length and the fasteners of the second length.

10. The powered fastener driver of claim 1, wherein the pivot member is coupled to the magazine by a pin that defines the pivot axis.

11. The powered fastener driver of claim 1, wherein the pivot member includes a pair of parallel pivot arms spaced apart by a distance, each pivot arm including a pivot aperture of a diameter, wherein a ratio of the distance to the diameter is greater than 1.5.

12. The powered fastener driver of claim 1, wherein the feed channel defines a feed direction along which the fasteners of the first and the second length are inserted into the magazine, and the pivot axis is parallel to the feed direction.

* * * * *